US010197948B2

(12) United States Patent
Iwatsuki et al.

(10) Patent No.: US 10,197,948 B2
(45) Date of Patent: Feb. 5, 2019

(54) DEVELOPING DEVICE AND IMAGE FORMING APPARATUS

(71) Applicants: Hitoshi Iwatsuki, Shizuoka (JP); Koichi Sakata, Shizuoka (JP); Hiroshi Tohmatsu, Shizuoka (JP); Toyoaki Tano, Shizuoka (JP); Kenichi Mashiko, Shizuoka (JP); Mariko Takii, Kanagawa (JP); Hiroyuki Kishida, Shizuoka (JP); Yoshihiro Murasawa, Shizuoka (JP); Keinosuke Kondoh, Kanagawa (JP); Toshio Koike, Tokyo (JP); Yutaka Takahashi, Kanagawa (JP)

(72) Inventors: Hitoshi Iwatsuki, Shizuoka (JP); Koichi Sakata, Shizuoka (JP); Hiroshi Tohmatsu, Shizuoka (JP); Toyoaki Tano, Shizuoka (JP); Kenichi Mashiko, Shizuoka (JP); Mariko Takii, Kanagawa (JP); Hiroyuki Kishida, Shizuoka (JP); Yoshihiro Murasawa, Shizuoka (JP); Keinosuke Kondoh, Kanagawa (JP); Toshio Koike, Tokyo (JP); Yutaka Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/511,291

(22) PCT Filed: Aug. 31, 2015

(86) PCT No.: PCT/JP2015/004422
§ 371 (c)(1),
(2) Date: Mar. 15, 2017

(87) PCT Pub. No.: WO2016/042717
PCT Pub. Date: Mar. 24, 2016

(65) Prior Publication Data

US 2017/0248871 A1 Aug. 31, 2017

(30) Foreign Application Priority Data

Sep. 17, 2014 (JP) ..... 2014-188794

(51) Int. Cl.
*G03G 15/09* (2006.01)
*G03G 9/113* (2006.01)
*G03G 15/06* (2006.01)

(52) U.S. Cl.
CPC ..... *G03G 15/0928* (2013.01); *G03G 9/1136* (2013.01); *G03G 9/1139* (2013.01); *G03G 15/065* (2013.01); *G03G 15/0907* (2013.01)

(58) Field of Classification Search
CPC ..... G03G 15/0907; G03G 15/0928
See application file for complete search history.

(56) References Cited

U.S. PATENT DOCUMENTS 6,406,826 B1 6/2002 Suzuki et al.
7,172,844 B2 2/2007 Umemura et al.
(Continued)

FOREIGN PATENT DOCUMENTS

JP 62-192758 8/1987
JP 04-157486 5/1992
(Continued)

OTHER PUBLICATIONS

Machine Translation of JP 2012-168225 A, obtained Dec. 1, 2017.*
(Continued)

*Primary Examiner* — Gregory H Curran
(74) *Attorney, Agent, or Firm* — Oblon, McClelland, Maier & Neustadt, L.L.P.

(57) ABSTRACT

A developing device, including: a developer containing toner and carrier; and developer bearer configured to have
(Continued)

surface thereof bear the developer and endlessly move, and to develop latent image over surface of latent image bearer by supplying toner in developer to latent image in developing region facing the latent image bearer, wherein carrier contains fine particles, value X in volume resistivity R ($=10^X$) (Ω·cm) of carrier is 11.5-16.0, developer bearer includes: magnetic field generating unit including a plurality of magnetic poles; and developing sleeve having a cylindrical shape enclosing magnetic field generating unit, and configured to bear developer over outer circumferential surface of cylindrical shape by magnetic force of the magnetic field generating unit and perform surface moving by rotating relative to developing device body, and developing device includes developing sleeve voltage applying unit configured to apply AC component-containing voltage to developing sleeve.

11 Claims, 9 Drawing Sheets

(56) References Cited

U.S. PATENT DOCUMENTS

| | | | |
|---|---|---|---|
| 7,261,989 | B2 | 8/2007 | Sugiura et al. |
| 7,318,989 | B2 | 1/2008 | Kotsugai et al. |
| 7,374,851 | B2 | 5/2008 | Nakayama et al. |
| 7,455,942 | B2 | 11/2008 | Nagatomo et al. |
| 7,664,439 | B2 | 2/2010 | Sugiura |
| 8,084,176 | B2 | 12/2011 | Iwamoto et al. |
| 2001/0055503 | A1 | 12/2001 | Kin et al. |
| 2003/0104297 | A1 | 6/2003 | Matsuda et al. |
| 2003/0186155 | A1 | 10/2003 | Aoki et al. |
| 2004/0076443 | A1 | 4/2004 | Suzuki et al. |
| 2005/0026064 | A1 | 2/2005 | Sugiura et al. |
| 2005/0079430 | A1 | 4/2005 | Aoki et al. |
| 2005/0089786 | A1 | 4/2005 | Sugiura et al. |
| 2005/0089787 | A1 | 4/2005 | Uchinokura et al. |
| 2005/0208408 | A1 | 9/2005 | Uchinokura et al. |
| 2006/0029433 | A1 | 2/2006 | Saito et al. |
| 2007/0190444 | A1 | 8/2007 | Kotsugai et al. |
| 2008/0014527 | A1 | 1/2008 | Kotsugai et al. |
| 2008/0213682 | A1 | 9/2008 | Saitoh et al. |
| 2008/0260400 | A1 | 10/2008 | Miyazawa et al. |
| 2008/0268366 | A1 | 10/2008 | Nakayama et al. |
| 2009/0214966 | A1 | 8/2009 | Kishida |
| 2011/0170915 | A1 | 7/2011 | Aoki et al. |
| 2012/0058423 | A1 | 3/2012 | Yamaguchi et al. |
| 2013/0016999 | A1 | 1/2013 | Tohmatsu et al. |
| 2013/0065175 | A1* | 3/2013 | Sakata ..... G03G 9/10 430/110.2 |
| 2013/0244162 | A1 | 9/2013 | Yamada et al. |
| 2013/0260299 | A1 | 10/2013 | Nakajima et al. |
| 2013/0260302 | A1 | 10/2013 | Nakajima et al. |
| 2014/0072910 | A1 | 3/2014 | Iwatsuki et al. |
| 2014/0080052 | A1 | 3/2014 | Yaguchi et al. |
| 2014/0227638 | A1 | 8/2014 | Kishida et al. |
| 2014/0248557 | A1 | 9/2014 | Yaguchi et al. |

FOREIGN PATENT DOCUMENTS

| | | |
|---|---|---|
| JP | 05-019604 | 1/1993 |
| JP | 2768078 | 4/1998 |
| JP | 2933699 | 8/1999 |
| JP | 2963853 | 8/1999 |
| JP | 2001-188388 | 7/2001 |
| JP | 3416307 | 4/2003 |
| JP | 3815066 | 6/2006 |
| JP | 2008-203618 | 9/2008 |
| JP | 2010-054800 | 3/2010 |
| JP | 2012-168225 | 9/2012 |
| JP | 5224887 | 3/2013 |
| RU | 2 410 738 C1 | 1/2011 |

OTHER PUBLICATIONS

International Search Report and Written Opinion dated Nov. 2, 2015 for counterpart International Patent Application No. PCT/JP2015/004422 filed Aug. 31, 2015.

Extended European Search Report dated Aug. 21, 2017 in Patent Application No. 15842282.4.

Combined Office Action and Search Report dated Mar. 19, 2018 in Russian Patent Application No. 2017111194/28 (019791) with English translation, 14 pages.

Official Communication in corresponding European Application No. 15842282.4 dated May 15, 2018.

* cited by examiner

[Fig. 1]
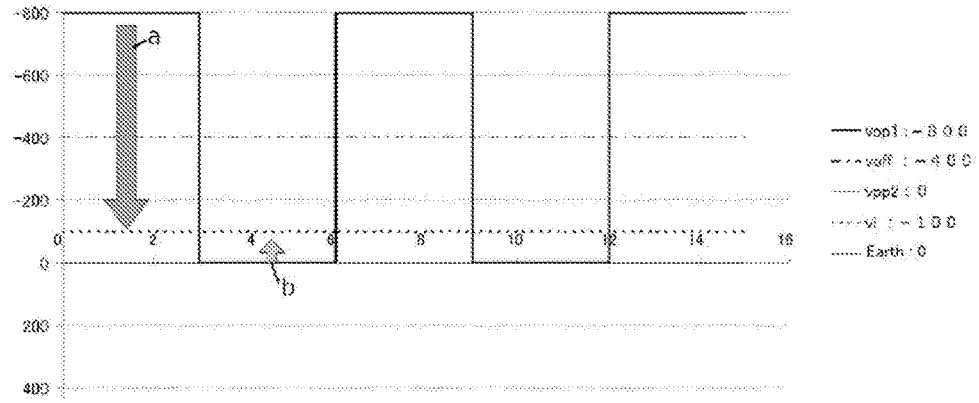
[Fig. 2]
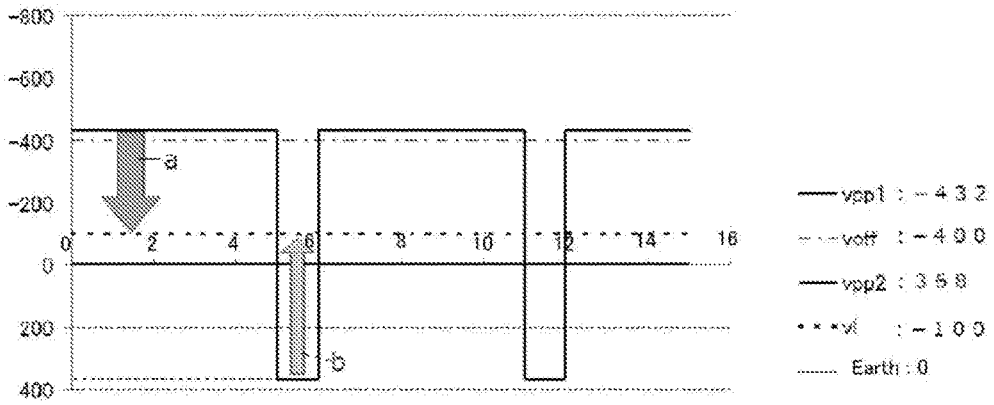
[Fig. 3]
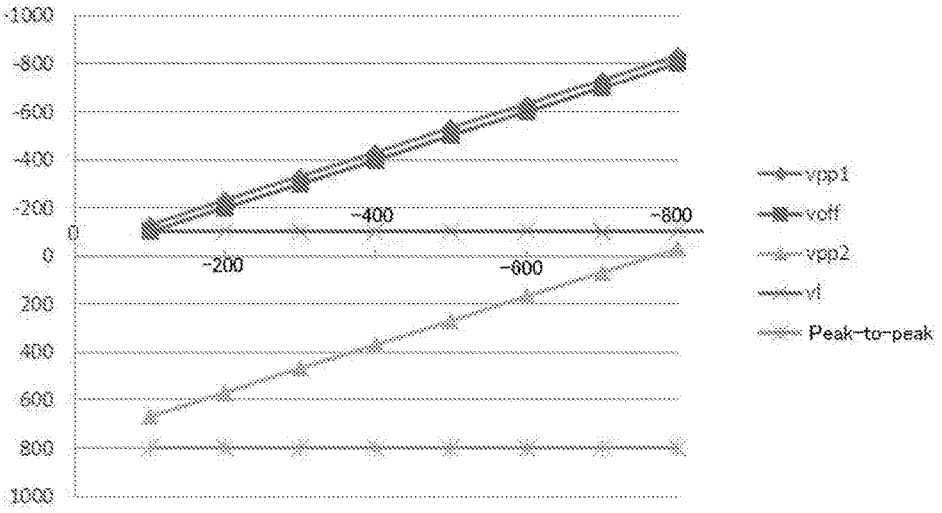

[Fig. 4]
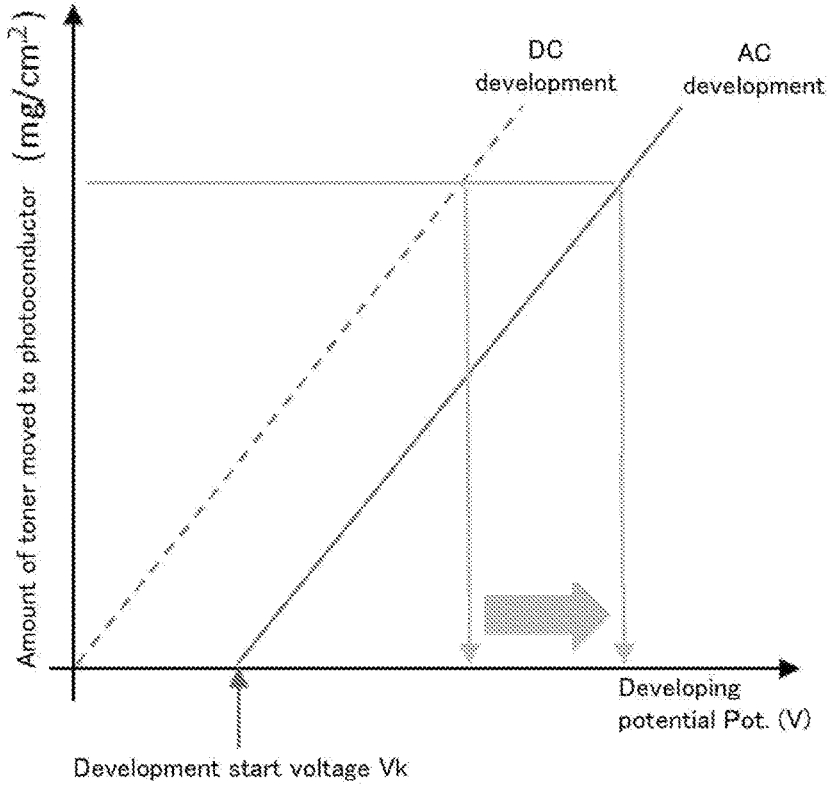
[Fig. 5]
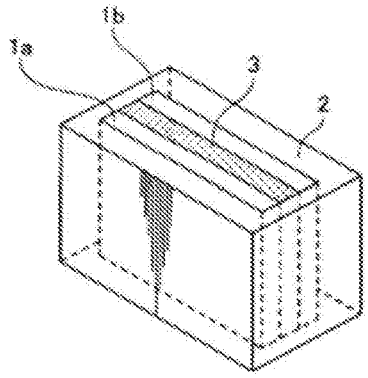
[Fig. 6-A]
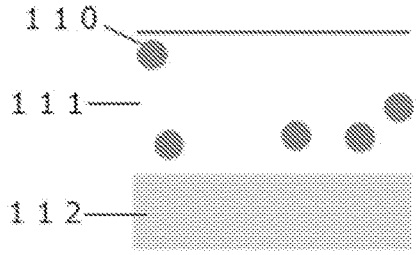

[Fig. 6-B]
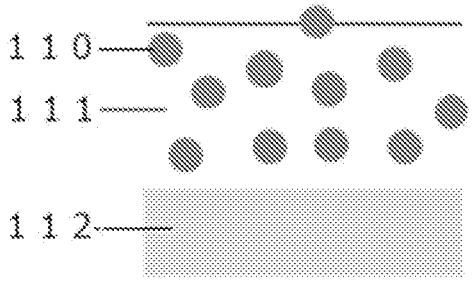
[Fig. 6-C]
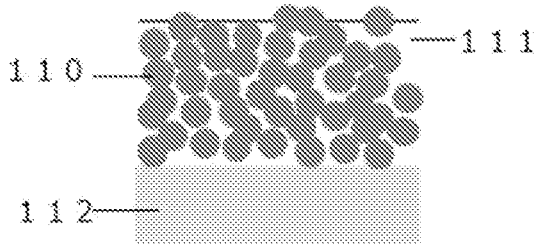
[Fig. 7-A]
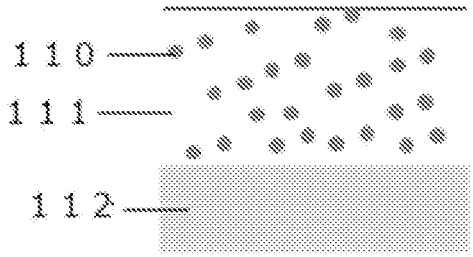
[Fig. 7-B]
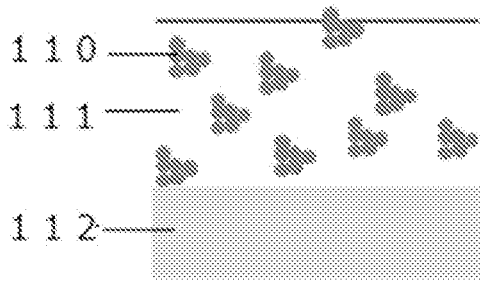

[Fig. 8]
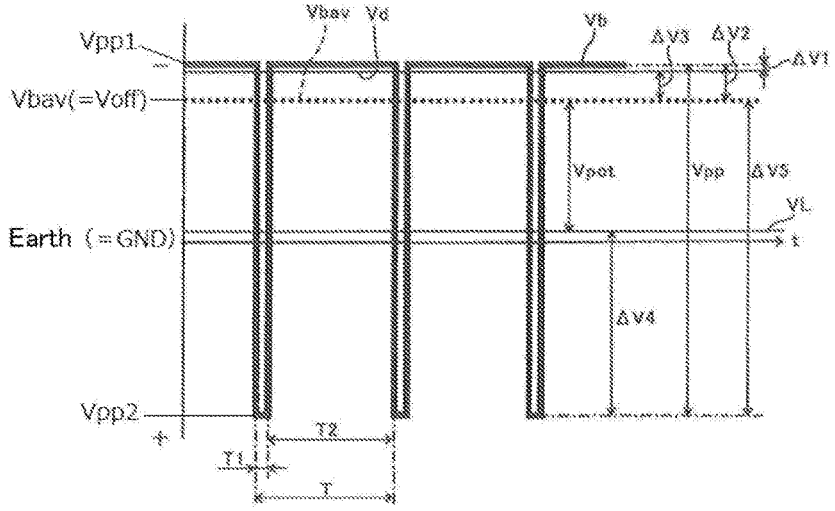
[Fig. 9]
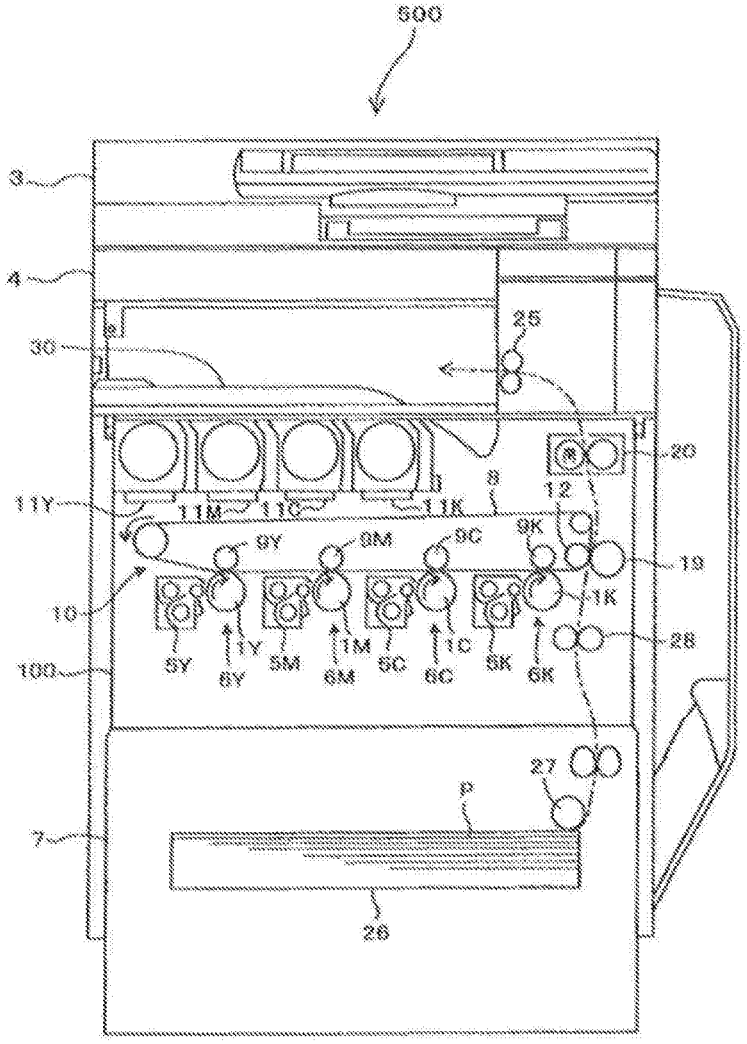

[Fig. 10]
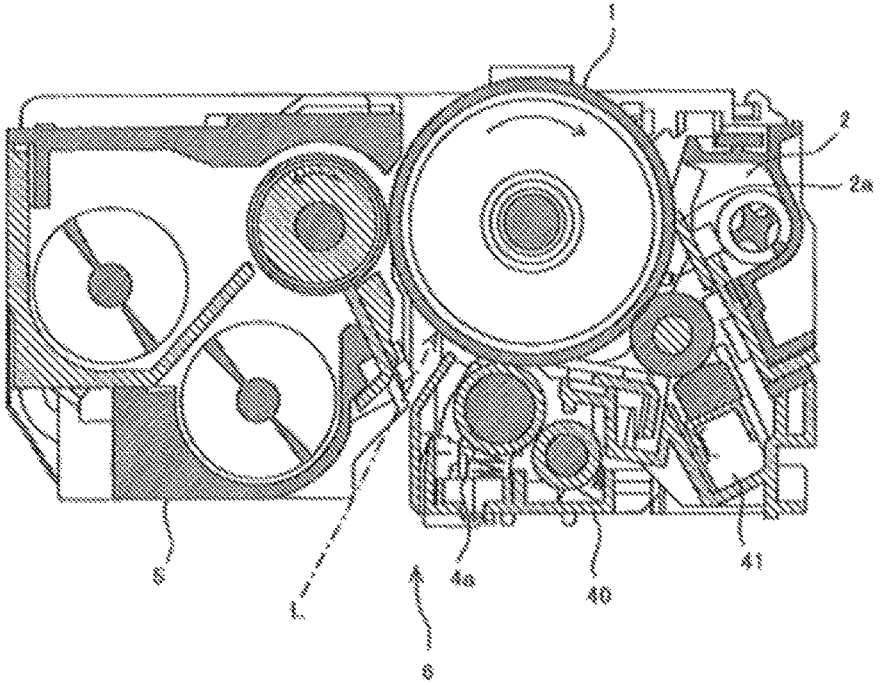
[Fig. 11]
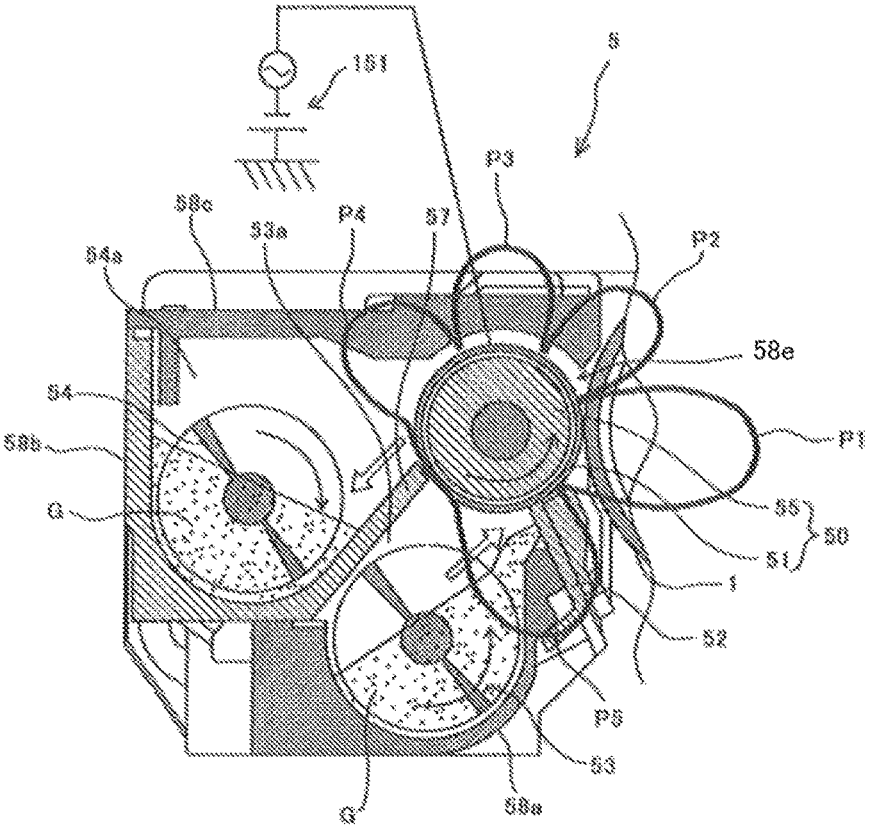

[Fig. 12]
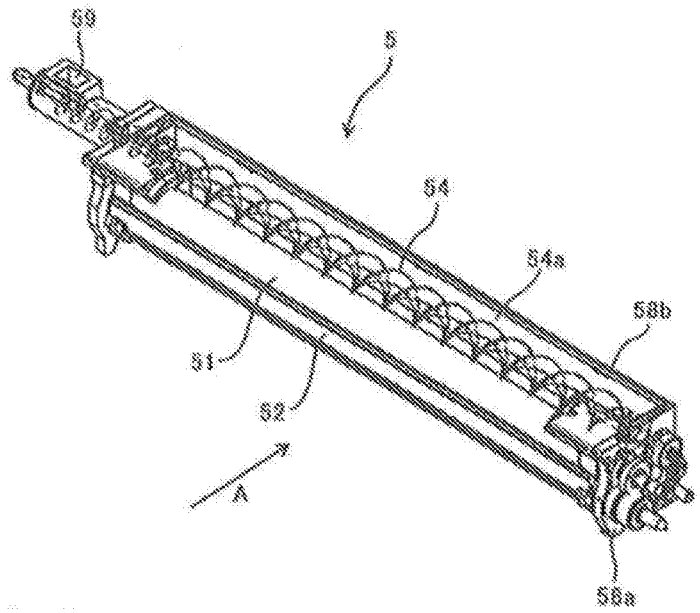
[Fig. 13-A]
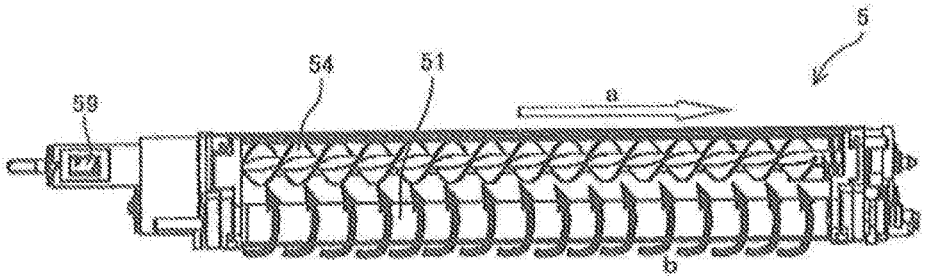
[Fig. 13-B]
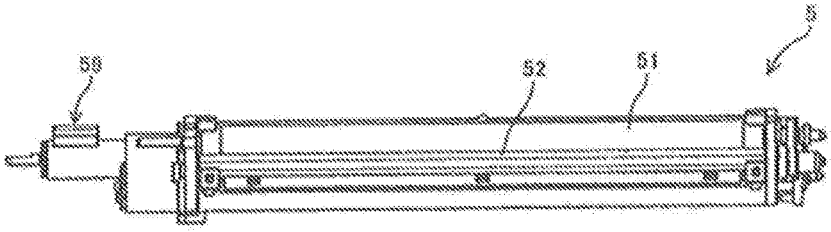
[Fig. 13-C]
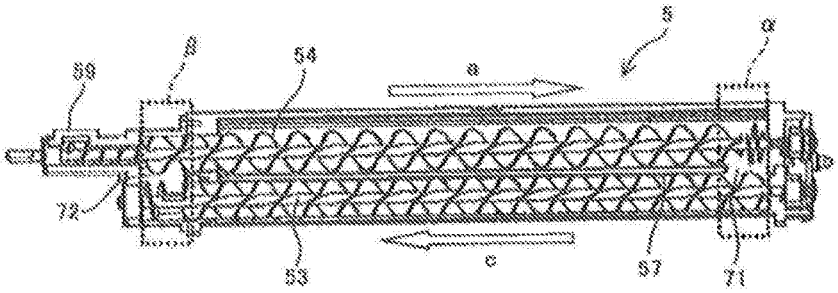

[Fig. 14]
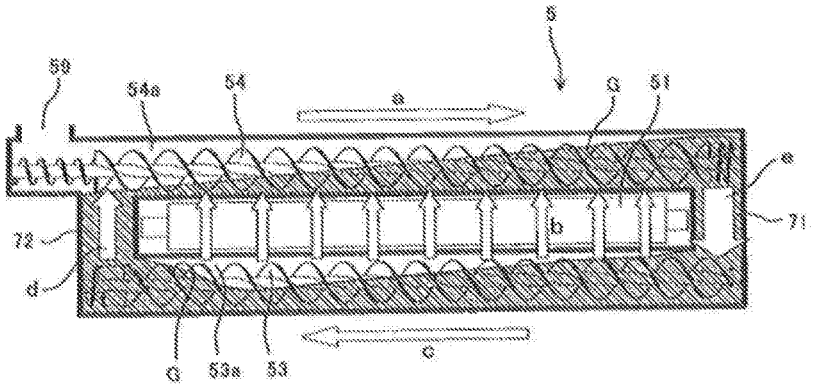
[Fig. 15]
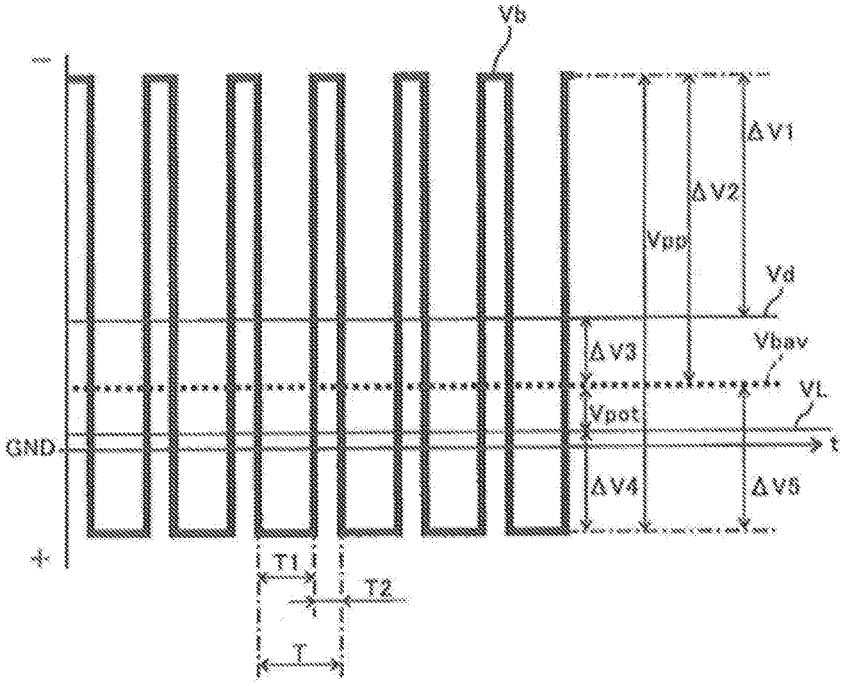
[Fig. 16]
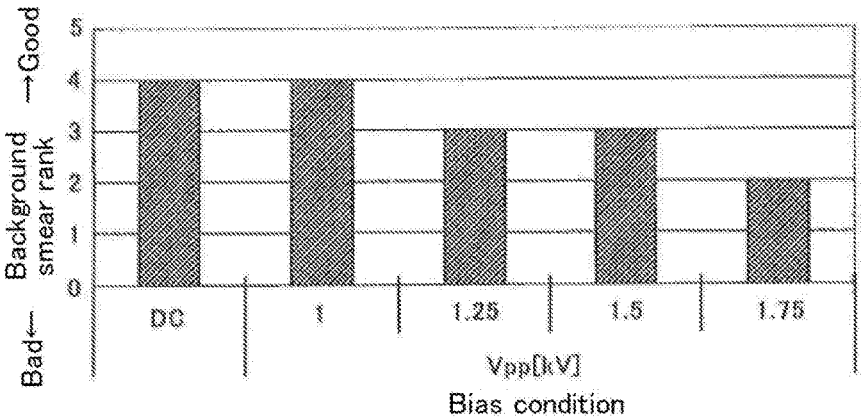

[Fig. 17]
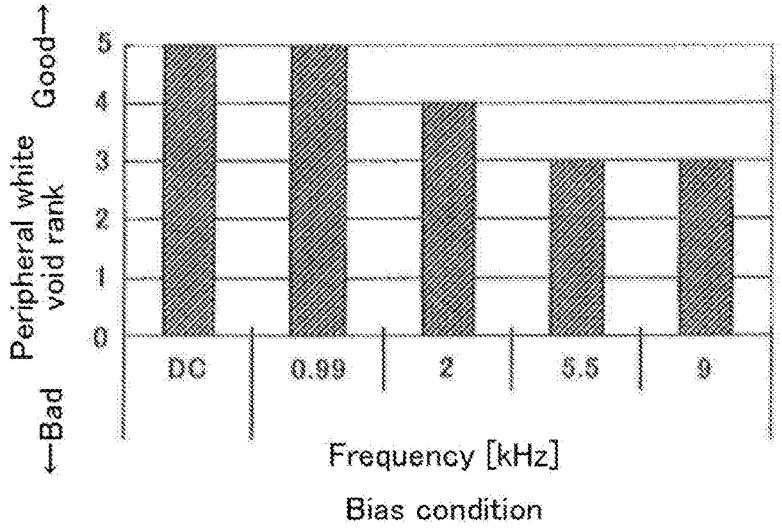
[Fig. 18]
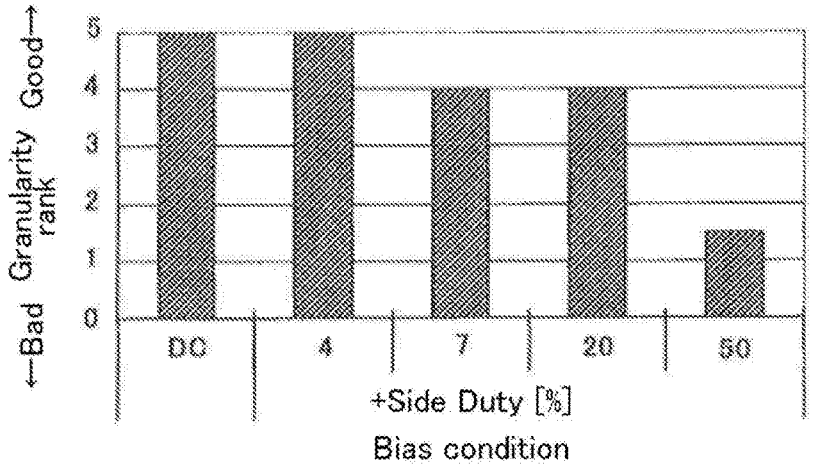
[Fig. 19]
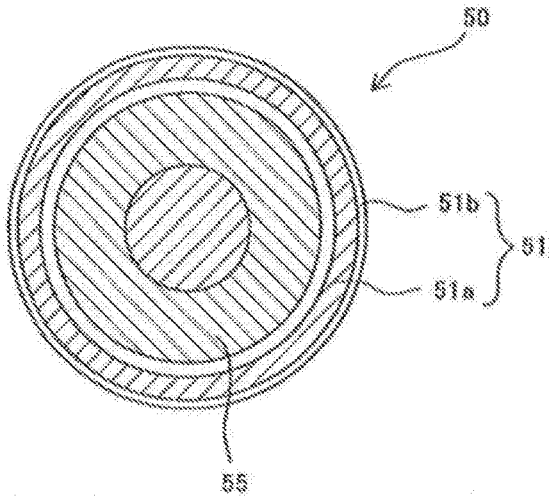

[Fig. 20-A]
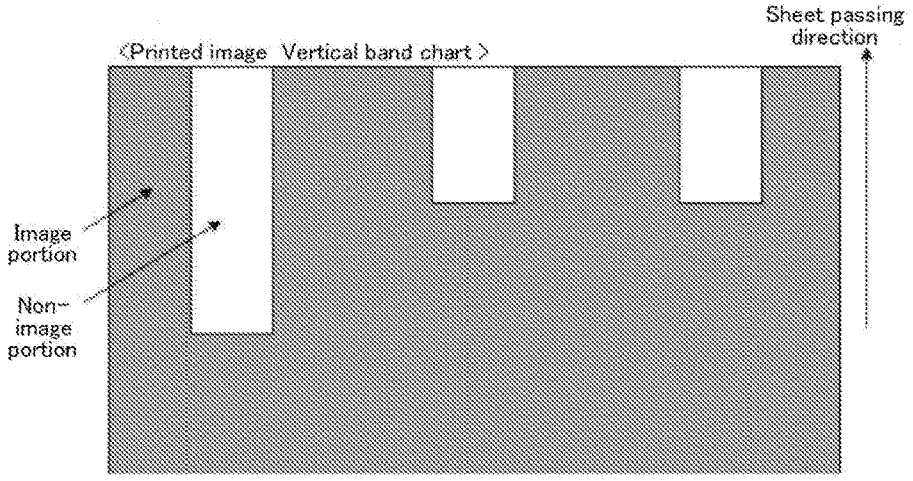
[Fig. 20-B]
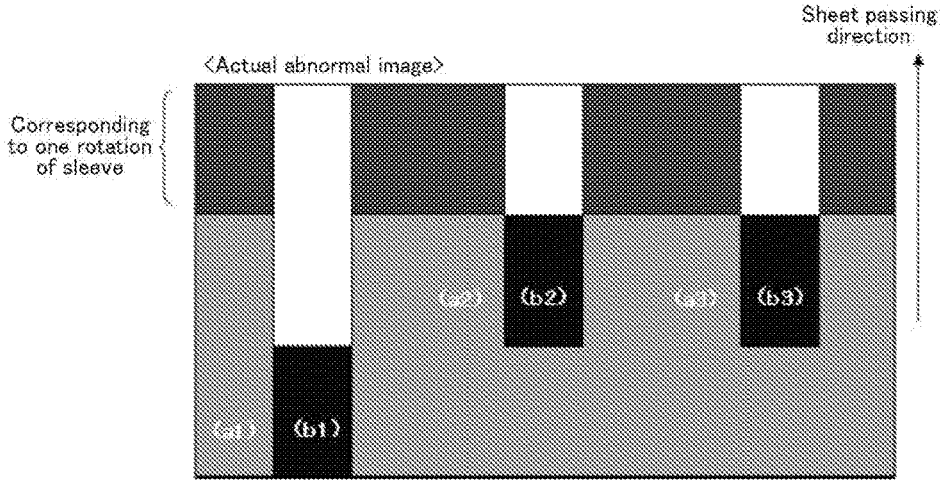
[Fig. 21]
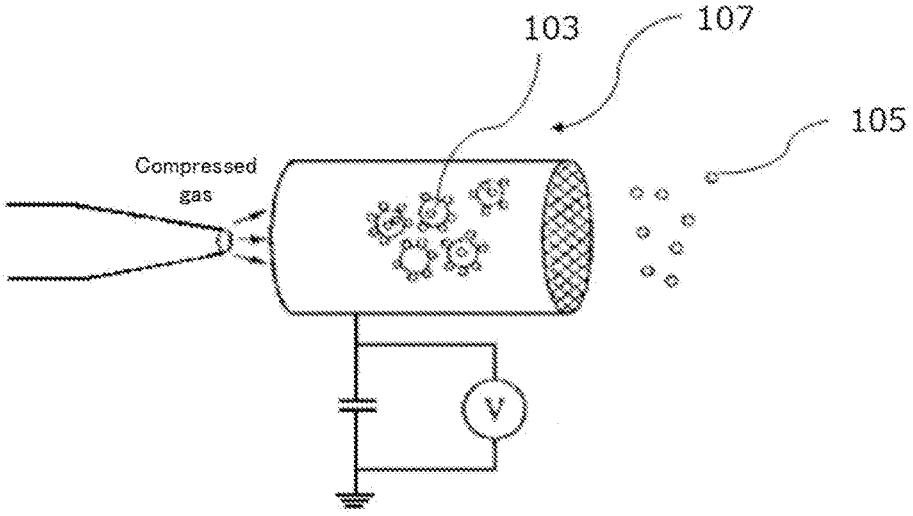

DEVELOPING DEVICE AND IMAGE FORMING APPARATUS

TECHNICAL FIELD

The present invention relates to a developing device effectively usable as a developing unit of an image forming apparatus such as a copier, a facsimile machine, and a printer, and an image forming apparatus including the developing device.

BACKGROUND ART

Conventionally, there has been known a developing device configured to develop a latent image formed over a latent image bearer by a developing unit. For example, there is a two-component-type developing device that uses as a developer, a two-component developer containing a toner and a carrier to develop a latent image formed over a latent image bearer. In the two-component-type developing device, a portion of a surface of a developing sleeve constituting a developer bearer and a portion of a surface of an image bearer face each other and form a developing region. Under a magnetic field of a magnetic field generating unit provided in the developing sleeve, a magnetic brush is formed over the developing sleeve and brought close to or into contact with the latent image bearer in the developing region, to thereby attach the toner to the latent image over the surface of the latent image bearer and develop the latent image to a visible image.

In the developing device of this kind, the toner moves from the developing sleeve to the latent image bearer by the effect of a potential difference between the surface potential of the developing sleeve to which a developing voltage is applied and the surface potential of the latent image bearer. As the scheme for applying a developing voltage to the developing sleeve, there are known a scheme of applying a voltage containing only a direct-current component (hereinafter referred to as "DC bias development"), and a scheme of applying a voltage containing an alternating-current component (hereinafter referred to as "AC bias development") (see, e.g., PTL 1). Meanwhile, in recent years, there has been an acceleration in the changeover from monochrome to full-color in the electrophotographic copier or printer technologies, and the full-color market is in the expanding tendency. In image formation by such an electrophotographic full-color system, it is necessary to keep the amount of a toner over the latent image bearer faithful to the electrostatic latent image, in order to obtain a clear full-color image excellent in color reproducibility.

CITATION LIST

Patent Literature

PTL 1: Japanese Patent Application Laid-Open (JP-A) No. 04-157486

SUMMARY OF INVENTION

Technical Problem

As the result of earnest studies, the present inventors have found that in the DC bias development, a formed image may have cyclic density variations corresponding to the perimeter of the developing sleeve. This is considered due to changes of a gap between the latent image bearer and the developing sleeve (hereinafter referred to as "developing gap") during rotation of the developing sleeve corresponding to the rotation cycle of the developing sleeve, attributed to decentering of the developing sleeve due to a production error, etc.

On the other hand, the present inventors have confirmed that the AC bias development achieved improvement over the DC bias development in the cyclic density variations. Hence, the present inventors have decided to use the AC bias development for the developing unit, and gone on to study the AC bias development. As a result, it has turned out that there are unique problems to the use of the AC bias development.

The present inventors' studies have revealed that superimposition of an AC bias causes problems attributed to a plus-side bias (which promotes return to the sleeve), such as a toner void, and carrier adhesion to the latent image bearer and a ghost image along with an increase of the bias used due to an increase of a development start voltage. Here, a ghost image is a phenomenon that a difference in the amount of the toner over the latent image bearer due to the influence of the history of an immediately previous image manifests as a difference in the density on the image developed next.

The present invention was made in view of the problems described above, and aims to achieve the object described below. That is, an object of the present invention is to provide a developing device that can remedy cyclic density variations by using an AC developing bias, can reduce influences of a plus-side bias arising from the use of the AC developing bias, and can suppress degradation of the developing ability for a long term.

Solution to Problem

A means for solving the problems described above is as follows. That is, a developing device of the present invention is a developing device, including: a developer containing a toner and a carrier; and a developer bearer configured to have a surface thereof bear the developer thereon and endlessly move, and to develop a latent image over a surface of a latent image bearer by supplying the toner in the developer to the latent image in a developing region where the developer bearer faces the latent image bearer, wherein the carrier contains fine particles, and a value X in a volume resistivity R ($=10^X$) ($\Omega\cdot$cm) of the carrier is from 11.5 to 16.0, wherein the developer bearer includes: a magnetic field generating unit including a plurality of magnetic poles; and a developing sleeve having a cylindrical shape enclosing the magnetic field generating unit, and configured to bear the developer over an outer circumferential surface of the cylindrical shape by means of a magnetic force of the magnetic field generating unit and to perform surface moving by rotating relative to a body of the developing device, and wherein the developing device includes a developing sleeve voltage applying unit configured to apply a voltage containing an alternating-current component to the developing sleeve.

Advantageous Effects of Invention

The present invention can provide a developing device that can solve the various conventional problems described above, achieve the object described above, and suppress degradation of a developing ability for a long term while also suppressing cyclic density variations.

BRIEF DESCRIPTION OF DRAWINGS

FIG. 1 is a diagram showing an example of a waveform of an AC bias and explaining a move of a toner.

FIG. 2 is a diagram showing another example of a waveform of an AC bias and explaining a move of a toner.

FIG. 3 is a diagram showing a relationship among Vpp1, Vpp2, and Voff under a fixed condition of 800 V peak-peak.

FIG. 4 is a diagram showing a relationship between an amount of toner moved and a development start voltage in AC development.

FIG. 5 is a perspective diagram showing an example of a resistance measurement cell used for measuring a volume resistivity of a carrier.

FIG. 6-A is a diagram showing an image of a state of presence of fine particles in a coating layer of a carrier.

FIG. 6-B is a diagram showing an image of a state of presence of fine particles in a coating layer of a carrier.

FIG. 6-C is a diagram showing an image of a state of presence of fine particles in a coating layer of a carrier.

FIG. 7-A is a diagram showing an image of a state of presence of fine particles in a coating layer of a carrier.

FIG. 7-B is a diagram showing an image of a state of presence of fine particles in a coating layer of a carrier.

FIG. 8 is an explanatory diagram showing an example of a waveform of a developing bias applied to a developing sleeve of a developing device of the present invention.

FIG. 9 is a schematic configuration diagram showing an example of a copier according to an embodiment.

FIG. 10 is a schematic configuration diagram of an image forming unit.

FIG. 11 is an explanatory diagram showing an example of a developing device according to an embodiment.

FIG. 12 is a perspective diagram showing an example of a developing device in a state of a developing cover being removed.

FIG. 13-A is a top view showing an example of a developing device in a state of a developing cover being removed.

FIG. 13-B is a side elevation of a developing device.

FIG. 13-C is a sectional side elevation of a developing device.

FIG. 14 is a schematic diagram showing a longer-direction move and an accumulation state of a developer in a developing device.

FIG. 15 is an explanatory diagram showing another example of a waveform of a developing bias applied to a developing sleeve of a developing device of the present invention.

FIG. 16 is a diagram showing a result of an experimental example 1.

FIG. 17 is a diagram showing a result of an experimental example 2.

FIG. 18 is a diagram showing a result of an experimental example 3.

FIG. 19 is a diagram explaining a cross-section of a developing roller of a developing device.

FIG. 20-A is a diagram showing an example of a normal vertical band chart image.

FIG. 20-B is a diagram showing an example of an abnormal vertical band chart image.

FIG. 21 is a diagram explaining a measurement method (a blow-off method) for measuring an amount of static buildup in a developer.

DESCRIPTION OF EMBODIMENTS (Developing Device)

A developing device of the present invention includes a developer containing a toner and a carrier. The carrier contains fine particles, and a value X in the volume resistivity R ($=10^X$) (Ω·cm) of the carrier is from 11.5 to 16.0. Note that in the present specification, terms "fine particles", "minute particles", and "particles" are used to refer to particles. However, these terms are not intended to particularly limit the size of the particles they refer to, but are used solely for expediency to clarify whether the particles referred to are particles contained in the carrier, particles contained in the toner, or general particles. In the present specification, particles contained in the carrier will hereinafter be referred to as "fine particles", particles contained in the toner will hereinafter be referred to as "minute particles", and other particles will hereinafter be referred to as "particles". The developing device of the present invention also includes a developer bearer. The developer bearer includes a magnetic field generating unit and a developing sleeve. The developing device of the present invention also includes a developing sleeve voltage applying unit configured to apply a voltage containing an alternating-current component to the developing sleeve. The developing device of the present invention is used when mounting an image forming apparatus with a developing unit.

<Developer>

The developer contains a toner and a carrier.

<<Carrier>>

The carrier contains, for example, core particles, and a coating layer coating the core particles, and further contains other components according to necessity.

For example, it is important that the carrier contain fine particles in the coating layer, and that the value X in the volume resistivity R ($=10^X$) (Ω·cm) of the carrier be from 11.5 to 16.0, i.e., that the value X, which is a common logarithmic value $Log_{10}R$ of the volume resistivity R, be from 11.5 (Log Ω·cm) to 16.0 (Log Ω·cm). It is unfavorable that the common logarithmic value X of the volume resistivity R be less than 11.5 (Log Ω·cm), because followability to a developing bias will be high at such a value.

Superimposition of an AC bias is accompanied by problems attributed to a plus-side bias (which promotes return to the sleeve), such as a toner void, and carrier adhesion to a latent image bearer and a ghost image along with an increase of the bias used due to an increase of a development start voltage.

The present inventors have found that use of a carrier having a volume resistivity in the range described above makes it harder for the above-described plus-side bias-attributed problems to occur, because use of such a carrier moderates the followability of change of the developer resistance in response to change of the bias.

As shown in FIG. 1, in AC bias superimposition, an alternating-current (AC) component having a predetermined peak width is superimposed on an average bias (direct-current (DC) component; represented by Voff). Therefore, while the AC bias is applied as a minus-side component, the toner can move from a developing roller to the latent image bearer easily. In contrast, while the AC bias is applied as a plus-side component, the toner cannot move easily.

In the case where a peak-to-peak value of an AC bias is large (which is 800 V in FIG. 1), while the AC bias is applied as a plus-side component, the bias acts in a direction to return the toner from the latent image bearer. The arrow a in FIG. 1 means that a force of moving the toner from the developing roller to a photoconductor is acting, and the arrow b means that a force of moving the toner from the photoconductor to the developing roller is acting.

When a temporal ratio of the minus-side component of an AC bias is greater than that of the plus-side component thereof as shown in FIG. 2, the magnitude of the plus-side component is large, which causes the toner to be returned from the latent image bearer by a strong bias.

While the DC component (Voff) is low under a condition of 800 V peak-peak, the bias (Vpp2) to return from the latent image bearer is extremely strong, as shown in FIG. 3. Hence, there occurs a phenomenon that it is difficult for the toner to be developed at a low bias at which development is started, which requires an increase of the development start voltage, as shown in FIG. 4. Because of the increase of the development start voltage, a developing potential Vpot. required for the toner to be accumulated over the latent image bearer in a predetermined amount increases, which causes charge injection to charge the carrier from plus to minus, resulting in a side effect that the carrier having been charged to the same polarity as the toner is developed (i.e., adheres) on the latent image bearer.

The present inventors have found that when the volume resistivity of the carrier is extremely low, the carrier resistance changes steeply in response to steep changes of the bias as shown in FIG. 1 and FIG. 2, leading to the problem described above, whereas when the common logarithmic value X of the volume resistivity R of the carrier is 11.5 (Log Ω·cm) or greater, it is possible to reduce the above-described side effect with the moderate responsiveness to the bias.

The value X in the volume resistivity R ($=10^X$) (Ω·cm) of the carrier is from 11.5 to 16.0, i.e., the value X, which expresses the volume resistivity R as a common logarithmic value $\text{Log}_{10}R=X$, is from 11.5 (Log Ω·cm) to 16.0 (Log Ω·cm).

The volume resistivity can be measured with a cell shown in FIG. 5. Specifically, a carrier (3) is packed in the cell formed of a fluorine resin-made container (2) in which an electrode (1*a*) and an electrode (1*b*), both having a surface area of 2.5 cm×4 cm, are stored at a spacing of 0.16 cm. The cell is tapped ten times from a dropping height of 1 cm at a tapping speed of 30 taps/min. Next, a direct-current voltage of 1,000 V is applied across the electrode (1*a*) and the electrode (1*b*), and thirty seconds later, the resistance r[Ω] of the carrier is measured with a high resistance meter 4329A (manufactured by Yokogawa Hewlett Packard, Ltd.). The volume resistivity R (Ω·cm) is obtained according to the formula below, and from the result, $\text{Log}_{10}R=X$ can be calculated.

$$r\times(2.5\times4)/0.16 \qquad \text{Formula}$$

—Core Particles—

The core particles that have a magnetic property are not particularly limited, and arbitrary core particles may be selected according to the purpose as long as they are a magnetic body. Examples thereof include resin particles obtained by dispersing in a resin, a magnetic body such as a ferromagnetic metal such as iron and cobalt, an iron oxide such as magnetite, hematite, and ferrite, various alloys, and a compound. Among these, Mn-based ferrite, Mn—Mg-based ferrite, and Mn—Mg—Sr ferrite are preferable in terms of environmental concerns.

—Coating Layer—

The coating layer coats the surface of the core particles, and contains a resin and fine particles.

The coating layer can be formed by applying a coating layer forming solution containing the resin and the fine particles over the core particles.

The kind, size, and property of the fine particles to be used, and the dispersed state of the fine particles in the coating layer may be examined in order to provide the carrier with an electric resistance (volume resistivity) in a desired range.

The coating layer is not particularly limited, and an arbitrary coating layer may be selected according to the purpose as long as it is a coating layer containing the fine particles at a ratio of from 10% by mass to 85% by mass. The ratio of the fine particles is more preferably from 40% by mass to 85% by mass, and yet more preferably from 50% by mass to 80% by mass.

When the content of the fine particles is less than 10% by mass, the coating layer may be scraped off. When it is greater than 85% by mass, the coating layer may have a uniform resistance that contributes to a high followability to the developing bias, which is unfavorable.

It has been revealed that when the content of the fine particles is in the range described above, change of the developer resistance follows change of the bias moderately, which makes it less likely for the above-described plus-side bias-attributed problems to occur. Although the reason is uncertain, it is considered that the presence, at a predetermined ratio, of the fine particles having a lower resistance in the resin moiety having a higher resistance makes the resistance of the coating layer non-uniform, which, particularly at a low bias, allows the developer to behave like a developer having a high resistance that is dependent on the resin resistance, leading to a low bias followability.

The content of the fine particles is represented by the formula below.

Content of fine particles (% by mass)={fine particles/(total amount of fine particles and resin solid content)}

It has also been revealed that the state of presence of the fine particles in the coating layer is important. A uniformly dispersed state of the fine particles is unfavorable for the same reason as described above.

FIG. 6-A to FIG. 6-C and FIG. 7-A to FIG. 7-B are diagrams showing images of the state of presence of the fine particles in the coating layer. In FIG. 6-A to FIG. 6-C and FIG. 7-A to FIG. 7-B, the reference numeral 110 denote the fine particles, the reference numeral 111 denote the coating layer, and the reference numeral 112 denote the core particles.

The present inventors consider the state shown in FIG. 6-B preferable over those shown in FIG. 6-A and FIG. 6-C. Further, the state shown in FIG. 7-B in which the fine particles are aggregated to some degree and dispersed non-uniformly in the coating layer is preferable over the state shown in FIG. 7-A in which the fine particles are dispersed uniformly in the coating layer.

In the present invention, the size of the fine particles dispersed in the coating layer, i.e., the particle diameter of the fine particles in the coating layer (hereinafter may also be referred to as "dispersed particle diameter of the fine particles") is preferably from 50 nm to 600 nm, as will be described below. It is considered that even if fine particles having a small average particle diameter are used, i.e., even if the size of the fine particles themselves is small, the effect of the present invention is ensured as long as the dispersed particle diameter of the fine particles is from 50 nm to 600 nm as the result of adjustment of dispersion conditions of the fine particles, a dispersion method, etc. For example, in the case of FIG. 7-B in which the fine particles are produced as aggregates of some fine particles, the aggregates of the fine particles may be in the range of from 50 nm to 600 nm.

The dispersed particle diameter of the fine particles in the coating layer can be measured by, for example, observing a cross-section of the carrier with a transmission electron microscope (TEM), measuring an arbitrary hundred particles, and obtaining the average of the measurement values.

The thickness of the coating layer can be controlled based on the content of the resin relative to the core particles. The content of the resin relative to the core particles is not particularly limited, and may be appropriately selected according to the purpose. However, it is preferably from 0.5% by mass to 3.0% by mass because it is possible to form a locally low-resistance state.

An average thickness h of the coating layer is not particularly limited, and may be appropriately selected according to the purpose. However, when the coating layer is too thin, the surface of the core particles will be easily exposed due to stirring in a developing device, which may lead to a large change of the resistance value. When the coating layer is too thick, protrusions of the core particles will not be exposed, which makes it difficult for a locally low-resistance state to be formed. The thickness of the coating layer can be controlled based on the content of the resin relative to the core particles.

The average thickness h of the coating layer can be measured by, for example, observing a cross-section of the carrier with a transmission electron microscope (TEM), measuring the thickness of the resin moiety of the coating layer coating the surface of the carrier, and obtaining the average of the thickness. Specifically, from the cross-section of the carrier, the distance from the surface of the core particle to the surface of the coating layer is measured at arbitrary fifty positions, and the average of the measurement values is calculated.

—Resin—

The resin is not particularly limited, and an arbitrary resin may be selected according to the purpose. Examples thereof include an acrylic resin, an amino resin, a polyvinyl-based resin, a polystyrene-based resin, a halogenated olefin resin, polyester, poly-carbonate, polyethylene, polyvinyl fluoride, polyvinylidene fluoride, polytrifluoroethylene, polyhexafluoropropylene, a vinylidene fluoride-vinyl fluoride copolymer, a fluoroterpolymer such as a tetrafluoroethylene-vinylidene fluoride-nonfluorinated monomer terpolymer, and a silicone resin. One of these may be used alone, or two or more of these may be used in combination. Among these, a silicone resin is preferable.

As the resin, a resin that contains a cured product of a mixture containing a silane coupling agent and a silicone resin can be used favorably.

The silicone resin is not particularly limited, and an arbitrary silicone resin may be selected according to the purpose. However, it is preferable to use a resin that contains a cross-linked product obtained by hydrolyzing a copolymer containing at least a moiety A represented by the general formula (A) below and a moiety B represented by the general formula (B) below, and condensing a produced silanol group.

[Chem. 1]

General Formula (A)

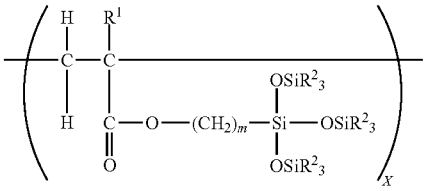

where in General Formula (A) above, $R^1$ represents either a hydrogen atom or a methyl group, $R^2$ represents an alkyl group having 1 to 4 carbon atoms, m represents an integer of from 1 to 8, and X represents a molar ratio in the copolymer, which is from 10 mol % to 90 mol %.

[Chem. 2]

General Formula (B)

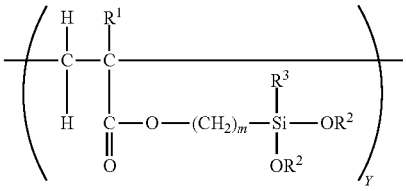

where in General Formula (B) above, $R^1$ represents either a hydrogen atom or a methyl group, $R^2$ represents an alkyl group having 1 to 4 carbon atoms, $R^3$ represents either an alkyl group having 1 to 8 carbon atoms or an alkoxy group having 1 to 4 carbon atoms, m represents an integer of from 1 to 8, Y represents a molar ratio in the copolymer, which is from 10 mol % to 90 mol %.

The silane coupling agent can disperse the fine particles stably.

The silane coupling agent is not particularly limited, and an arbitrary silane coupling agent can be selected according to the purpose. Examples thereof include γ-(2-aminoethyl) aminopropyl trimethoxy silane, γ-(2-aminoethyl)aminopropyl methyl dimethoxy silane, γ-methacryloxy propyl trimethoxy silane, N-β-(N-vinyl benzyl aminoethyl)γ-aminopropyl trimethoxy silane hydrochloride, γ-glycidoxy propyl trimethoxy silane, γ-mercapto propyl trimethoxy silane, methyl trimethoxy silane, methyl triethoxy silane, vinyl triacetoxy silane, γ-chloropropyl trimethoxy silane, hexamethyl disilazane, γ-anilinopropyl trimethoxy silane, vinyl trimethoxy silane, octadecyl dimethyl [3-(trimethoxy silyl)propyl] ammonium chloride, γ-chloropropyl methyl dimethoxy silane, methyl trichlorosilane, dimethyl dichlorosilane, trimethyl chlorosilane, allyl triethoxy silane, 3-aminopropyl methyl diethoxy silane, 3-aminopropyl trimethoxy silane, dimethyl diethoxy silane, 1,3-divinyl tetramethyl disilazane, and methacryloxy ethyl dimethyl (3-trimethoxy sylyl propyl) ammonium chloride. One of these may be used alone, or two or more of these may be used in combination.

The silane coupling agent may be an appropriately prepared product, or may be a commercially available product. Examples of the commercially available product include AY43-059, SR6020, SZ6023, SH6020, SH6026, SZ6032, SZ6050, AY43-310M, SZ6030, SH6040, AY43-026, AY43-

031, SH6062, Z-6911, SZ6300, SZ6075, SZ6079, SZ6083, SZ6070, SZ6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all manufactured by Toray Silicone Co., Ltd.).

The content of the silane coupling agent is not particularly limited, and may be appropriately selected according to the purpose. However, it is preferably from 0.1% by mass to 10% by mass relative to the binder resin. When the content is less than 0.1% by mass, the adhesiveness between the core particles or the fine particles and the binder resin may be poor, and the coating layer may drop off during a long-term use. When the content is greater than 10% by mass, toner filming may occur during a long-term use.

The coating layer can be formed with a coating layer composition containing: the silicone resin having a silanol group, or a hydrolyzable functional group, or both; a polymerization catalyst; if necessary, a resin other than the silicone resin having a silanol group, or a hydrolyzable functional group, or both; and a solvent.

Specifically, the coating layer may be formed by condensing a silanol group while coating the core particles with the coating layer composition, or may be formed by condensing a silanol group after coating the core particles with the coating layer composition.

The method for condensing a silanol group while coating the core particles with the coating layer composition is not particularly limited. Examples of the method include a method of coating the core particles with the coating layer composition while applying heat, light, etc.

The method for condensing a silanol group after coating the core particles with the coating layer composition is not particularly limited, and an arbitrary method may be selected according to the purpose. Examples of the method include a method of coating the core particles with the coating layer composition, and after this heating them.

—Fine Particles—

The fine particles are not particularly limited, and arbitrary particles may be selected according to the purpose. However, it is preferable that the fine particles contain one or more of alumina, silica, titanium, barium, tin, and carbon.

The fine particles may be conductive fine particles or may be non-conductive fine particles, or may contain conductive fine particles and non-conductive fine particles in combination.

The conductive fine particles refer to fine particles having a powder resistivity of 100 Ω·cm or less. The non-conductive fine particles refer to fine particles having a powder resistivity of greater than 100 Ω·cm.

The powder resistivity can be measured in the manner described below, for example. A sample (5 g) is put in a cylindrical vinyl chloride tube having an inner diameter of 1 cm, and the tube is interposed between upper and lower electrodes. A pressure of 10 kg/cm$^2$ is applied to these electrodes with a pressing machine. Then, in this pressured state, the electrodes are connected to an LCR meter (4216A manufactured by Yokogawa Hewlett Packard, Ltd.). The resistance r (Ω) immediately after the connection is read, an overall length L (cm) is measured with a caliper, and the powder resistivity (Ω·cm) is calculated. The calculation formula is represented by the formula below.

$$\text{Powder resistivity } (\Omega\cdot\text{cm}) = \{(2.54/2)2\times\pi\}\times r/(L-11.35)$$

r: Resistance immediately after connection

L: Overall length of the tube when filled with the sample 11.35: Overall length of the tube when not filled with the sample The conductive fine particles are not particularly limited, and arbitrary conductive fine particles may be selected according to the purpose. Examples thereof include: conductive fine particles obtained by forming a layer of tin dioxide, indium oxide, or the like over a base material such as aluminium oxide, titanium dioxide, zinc oxide, silicon dioxide, barium sulfate, zirconium oxide, or the like; and conductive fine particles formed with carbon black. Among these, conductive fine particles obtained by forming a layer of tin dioxide or indium dioxide over a base material such as aluminium oxide, titanium dioxide, or barium sulfate are preferable.

The non-conductive fine particles are not particularly limited, and arbitrary non-conductive fine particles may be selected according to the purpose. Examples thereof include aluminium oxide, titanium dioxide, zinc oxide, silicon dioxide, barium sulfate, and zirconium oxide.

The powder resistivity of the fine particles is not particularly limited, and may be appropriately selected according to the purpose. However, it is preferably from −3 (Log Ω·cm) to 3 (Log Ω·cm). When the powder resistivity is less than −3 (Log Ω·cm), there are problems that the resistance of the fine particles is too low for the fine particles to sufficiently charge the toner during frictional charging with the toner, and that the followability to the developing bias is extremely high, which requires an increase of the development start voltage in AC bias superimposition. When the powder resistivity is greater than 3 (Log Ω·cm), the fine particles do not have a sufficient ability to adjust the carrier resistance, which may cause an edge effect and degrade the image definition.

A volume average particle diameter D of the fine particles is preferably from 50 nm to 600 nm, and more preferably from 100 nm to 400 nm, which are relatively large particle diameters. With a particle diameter in the range described above, the fine particles can get out from the surface of the resin coating layer and form a partially low-resistance state easily, a spent material over the carrier surface can be scraped off easily, and wear resistance is excellent. When the volume average particle diameter D is less than 50 nm, the resin and the fine particles will be mixed uniformly, and the coating film resistance will be uniform, which makes the bias followability high, requiring an increase of the development start voltage in AC bias superimposition, problematically.

In the present invention, it is preferable to use fine particles that are relatively large themselves with such an average particle diameter described above. However, the fine particles are not limited to such fine particles, but encompass fine particles that are made into a state of being dispersed in the coating layer in the form of aggregates as shown in FIG. 7B, with appropriate selection of the kind and size of the fine particles, the method for dispersing the fine particles in the coating layer, the method for forming the coating layer, etc. In this case, as described above, it is only necessary that the dispersed particle diameter of the fine particles in the coating layer be from 50 nm to 600 nm, i.e., that the aggregates of fine particles be in the range of from 50 nm to 600 nm.

The volume average particle diameter D of the fine particles can be measured with, for example, an ultracentrifugal automatic granularity distribution meter CAPA-700 (manufactured by Horiba, Ltd.). Specifically, the measurement is performed according to the procedure described below.

In a juicer-mixer, a toluene solution (300 mL) is poured to amino silane (SH6020 manufactured by Dow Corning Toray Co., Ltd.) (30 mL). A sample (6.0 g) is added thereto, and they are dispersed with the mixer rotation speed set to a low level. The dispersion liquid is diluted by being added in an adequate amount to a toluene solution (500 mL) previously prepared in a 1,000 mL beaker. The obtained diluted solution is kept being stirred with a homogenizer constantly. The volume average particle diameter is measured with an ultracentrifugal automatic granularity distribution meter CAPA-700 (manufactured by Horiba, Ltd.).

—Measurement Conditions—

Rotation speed: 2,000 rpm

Maximum granularity: 2.0 μm

Minimum granularity: 0.1 μm

Granularity interval: 0.1 μm

Dispersion medium viscosity: 0.59 mPa·s

Dispersion medium density: 0.87 g/cm$^3$

Particle density: an absolute specific gravity measured with a dry automatic bulk density meter ACUPIC 1330 (manufactured by Shimadzu Corporation)

<<<Weight Average Particle Diameter Dw of Electrostatic Latent Image Developing Carrier>>>

A weight average particle diameter Dw of the carrier refers to a particle diameter at a cumulative percentage of 50% in a granularity distribution of the core particles obtained by a laser diffraction/scattering method.

The weight average particle diameter Dw of the carrier is not particularly limited, and may be appropriately selected according to the purpose However, it is preferably from 20 μm to 65 μm. With a weight average particle diameter in the range described above, there will be remarkable effects of curing carrier adhesion and improving image quality. A weight average particle diameter of less than 20 μm is unfavorable because such a problem as carrier adhesion will occur due to a poor particle uniformity and inexistence of a technique for skillfully handling such particles with a machine. On the other hand, a weight average particle diameter of greater than 65 μm is unfavorable because a fine image cannot be obtained with a poor reproducibility of image details.

The weight average particle diameter Dw is calculated based on a granularity distribution of the particles measured on the basis of the number of particles (i.e., a relationship between number frequency and particle diameter).

In this case, the weight average particle diameter Dw is represented by the formula below.

$$Dw=\{1/\Sigma(nD^2)\}\times\{\Sigma(nD^4)\}$$

(In the formula above, D represents a representative particle diameter (m) of the particles present in each channel, and n represents a total number of particles present in each channel.)

The channel represents a length by which the particle diameter range of a particle diameter distribution diagram is divided into measurement width units. In the present invention, an equally dividing length (a particle diameter distributed width) of 2 μm is employed.

As the representative particle diameter of the particles present in each channel, the minimum value among the particle diameters of the particles present in each channel is employed.

Further, in the present invention, a number average particle diameter Dp is calculated based on a granularity distribution of the particles measured on the basis of the number of particles.

In this case, the number average particle diameter Dp is represented by the formula below.

$$Dp=(1/N)\times(\Sigma nD)$$

(In the formula above, N represents a total number of particles measured, n represents a total number of particles present in each channel, and D represents a minimum value of particle diameters of the particles present in each channel (2 μm)).

In the present invention, a microtrack granularity analyzer (a model HRA9320-X100 manufactured by Honeywell Inc.) is used as a granularity analyzer for measuring a granularity distribution. Measurement conditions are as follows.

[1] Particle diameter range: from 100 nm to 8 μm

[2] Channel length (channel width): 2 μm

[3] Number of channels: 46

[4] Refractive index: 2.42

<<<Magnetization of Electrostatic Latent Image Developing Carrier>>>

Magnetization (magnetic moment) of the carrier is not particularly limited, and may be appropriately selected according to the purpose. However, it is preferably from 40 Am$^2$/kg to 90 Am$^2$/kg under a magnetic field of 1 kOe.

A high sensitivity vibrating sample magnetometer (VSM-P7-15 manufactured by Toei Industry Co., Ltd.) can be used for measuring the magnetization. As a specific measurement method, the carrier is weighed out in about 0.15 g, and packed in a cell having an inner diameter of 2.4 mm and a height of 8.5 mm, and the magnetization is measured under a magnetic field of 1,000 oersted (Oe).

<<Toner>>

The toner contains, for example, a binder resin, a charge controlling agent, and a release agent, and further contains other components according to necessity.

The toner is in the form of containing a colorant, minute particles, the charge controlling agent, the release agent, etc. in the binder resin mainly composed of a thermoplastic resin, and may be any of various types of conventionally publicly-known toners. A method for producing the toner is not particularly limited, and an arbitrary toner production method may be selected from conventionally publicly-known methods according to the purpose. Examples of the methods include a pulverization method, a polymerization method, and a granulation method. The shape of the toner may be an indefinite shape or may be a spherical shape. The toner may be a magnetic toner or may be a non-magnetic toner.

The binder resin is not particularly limited, and an arbitrary binder resin may be selected according to the purpose. Examples thereof include: a styrene-based binder resin including a homopolymer of styrene or a substitution product thereof, such as polystyrene, and polyvinyl toluene, and a styrene-based copolymer such as a styrene-p-chlorostyrene copolymer, a styrene-propylene copolymer, a styrene-vinyl toluene copolymer, a styrene-methyl acrylate copolymer, a styrene-ethyl acrylate copolymer, a styrene-butyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ether copolymer, a styrene-methyl vinyl ketone copolymer, a styrene-butadiene copolymer, a styrene-isoprene copolymer, a styrene-maleic acid copolymer, and a styrene-maleate copolymer; a an acrylic-based binder resin such as polymethyl methacrylate, and polybutyl methacrylate; a polyvinyl chloride resin; a polyvinyl acetate resin; a polyethylene resin; a polypropylene resin; a polyester resin; a polyurethane resin; an epoxy resin; a polyvinyl butyral resin; a polyacrylic acid resin; rosin; modified rosin; a terpene resin; a phenol resin; an aliphatic or aliphatic hydrocarbon resin; an aromatic petroleum resin; chlorinated paraffin; and a paraffin wax. One of these may be used alone, or two or more of these may be used in combination. Among these, a polyester resin is preferable because it can suppress a melt viscosity of the toner more while securing storage stability thereof.

The polyester resin is not particularly limited, and an arbitrary polyester resin may be selected according to the purpose. Examples thereof include a resin obtained by a polycondensation reaction between an alcohol component and a carboxylic acid component. The polyester resin may be used in combination with a crystalline polyester resin.

The alcohol component is not particularly limited, and an arbitrary alcohol component may be selected according to the purpose. Examples thereof include: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and poly-oxypropylenated bisphenol A; divalent alcohol monomers obtained by substituting a saturated or unsaturated hydrocarbon group having 3 to 22 carbon atoms in those described above; other divalent alcohol monomers; and trivalent or greater high alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methyl propanetriol, 2-methyl-1,2,4-butanetriol, trimethylolethane, trimethylolpropane, and 1,3,5-trihydroxy methyl benzene. One of these may be used alone, or two or more of these may be used in combination.

The carboxylic acid component is not particularly limited, and an arbitrary carboxylic acid component may be selected according to the purpose. Examples thereof include: a monocarboxylic acid such as a palmitic acid, a stearic acid, and an oleic acid; a maleic acid; a fumaric acid; a mesaconic acid; a citraconic acid; a terephthalic acid; a cyclohexane dicarboxylic acid; a succinic acid; an adipic acid; a sebacic acid; a malonic acid; a divalent organic acid monomer obtained by substituting a saturated or unsaturated hydrocarbon group having 3 to 22 carbon atoms in those described above; an anhydride of those acids described above; a dimer acid composed of a short-chain alkyl ester and a linolenic acid; a 1,2,4-benzene tricarboxylic acid; a 1,2,5-benzene tricarboxylic acid; a 2,5,7-naphthalene tricarboxylic acid; a 1,2,4-naphthalene tricarboxylic acid; a 1,2,4-butane tricarboxylic acid; a 1,2,5-hexane tricarboxylic acid; 1,3-dicarboxyl-2-methyl-2-methylene carboxy propane; tetra(methylene carboxyl)methane; a 1,2,7,8-octane tetracarboxylic acid; an empol trimer acid; and a trivalent or greater multivalent carboxylic acid monomer of an anhydride of those acids described above. One of these may be used alone, or two or more of these may be used in combination.

When used in combination with a crystalline polyester resin, the polyester resin can be fixed at a lower temperature, and can provide a greater glossiness to an image even at the lower temperature. At the glass transition temperature, the crystalline polyester resin causes a crystal transition, and sharply lowers its melt viscosity from its solid state, to thereby express a property of being fixed over a recording medium such as paper. Here, the crystalline polyester refers to a polyester having a crystallinity indicated by a crystallinity index that is defined as a ratio between a softening point and a maximum endothermic peak temperature by a differential scanning calorimeter (DSC), i.e., a softening temperature/maximum endothermic peak temperature. The crystalline polyester has a crystallinity index of from 0.6 to 1.5, preferably from 0.8 to 1.2.

The content of the crystalline polyester relative to the polyester resin is preferably from 1 part by mass to 35 parts by mass, and more preferably from 1 part by mass to 25 parts by mass relative to 100 parts by mass of the polyester resin. When the content is greater than 35 parts by mass, the toner is likely to cause filming over the surface of an image bearer such as a latent image bearer, and storage stability of the toner will be poor.

Examples of the epoxy resin include a polycondensation product of bisphenol A and epochlorohydrin. The epoxy-based resin may be an appropriately prepared product or may be a commercially available product. Examples of the commercially available product include: EPOMIK R362, R364, R365, R366, R367, and R369 (all manufactured by Mitsui Petrochemical Industries, Ltd.); EPOTOHTO YD-011, YD-012, YD-014, YD-904, and YD-017 (all manufactured by Tohto Kasei Co., Ltd.); and EPOCOAT 1002, 1004, and 1007 (all manufactured by Shell Chemical Japan Co.).

A colorant used in the toner may have an intended color tone obtained by using one of, or a mixture of any of conventionally publicly-known dyes or pigments, such as carbon black, lampblack, iron black, ultramarine, a nigrosine dye, aniline blue, phthalocyanine blue, Hansa yellow G, rhodamine 6G lake, chalco oil blue, chrome yellow, quinacridone, benzidine yellow, rose bengal, a triallyl methane-based dye, and a monoazo- or disazo-dye or pigment.

A transparent toner need not contain such a colorant.

A black toner may be a magnetic toner containing a magnetic body. The magnetic body is not particularly limited, and an arbitrary magnetic body may be selected according to the purpose. Examples thereof include a ferromagnetic body such as iron and cobalt, and minute particles of magnetite, hematite, Li-based ferrite, Mn—Zn-based ferrite, Cu—Zn-based ferrite, Ni—Zn-based ferrite, and Ba ferrite. For sufficient control of frictional chargeability of the toner, the toner may contain a so-called charge controlling agent such as a metal complex salt of a monoazo dye, a nitrohumic acid and a salt thereof, a salicylic acid, a naphthoate salt, a metal complex amino compound of a dicarboxylic acid with Co, Cr, and Fe, a quaternary ammonium compound, and an organic dye.

A white or transparent material such as a metal salt of a white salicylic acid derivative is preferable for a color toner other than a black toner.

The toner may contain a release agent according to necessity.

The release agent may be one of, or a mixture of any of a low-molecular-weight polypropylene, a low-molecular-weight polyethylene, a carnauba wax, a micro-crystalline wax, a jojoba wax, a rice wax, a montanic acid wax, etc. However, the release agent is not limited to these.

The toner may contain an additive. In order to obtain a favorable image, it is important to impart a sufficient flowability to the toner. To the purpose, it is generally effective to externally add minute particles of a hydrophobized metal oxide or minute particles of a lubricant as a flow improver. A metal oxide, organic resin minute particles, a metal soap, etc. may be used as an additive. Specific examples of such additives include: a lubricant such as a fluorine resin (e.g., polytetrafluoroethylene) and zinc stearate, and a polishing agent such as cerium oxide and silicon carbide; a flowability imparting agent such as an inorganic oxide such as $SiO_2$ and $TiO_2$ of which surface may be hydrophobized; and materials known as a caking inhibitor, and products obtained by applying a surface treatment to these materials. It is particularly preferable to use a hydrophobic silica to improve the flowability of the toner.

A weight average particle diameter of the toner used in the developer of the present invention is preferably from 3.0 μm to 9.0 μm, and more preferably from 3.0 μm to 6.0 μm.

The weight average particle diameter can be measured with, for example, COULTER MULTISIZER II (manufactured by Coulter Counter Inc.).

<<Method for Producing Developer>>

A method for producing the developer is not particularly limited, and an arbitrary method may be selected according to the purpose. Examples thereof include a method of producing a developer by mixing the carrier and the toner, and stirring them with a Turbula mixer.

<<Replenishment Developer>>

The replenishment developer contains the electrostatic latent image developing carrier of the present invention described above, and the toner. The replenishment developer can be used in an image forming apparatus configured to perform image formation while discharging any excess developer in a developing device. A developing device that uses the replenishment developer can achieve a stable image quality for an enormously long time. That is, an image forming apparatus that uses the replenishment developer can obtain stable images, because it can keep the amount of static buildup stable for a long time by replacing a degraded carrier in the developing device with a non-degraded carrier contained in the replenishment developer. This system is particularly effective for printing an image having a high image occupation area. Degradation of a carrier during printing of an image having a high image occupation area is mainly due to degradation of the charging ability of the carrier caused by toner spent on the carrier. With this system, the degraded carrier will be replaced at short cycles during printing of an image having a high image occupation area, because the amount of the carrier to be replenished will also be high.

The content of the carrier in the replenishment developer is not particularly limited, and may be appropriately selected according to the purpose. However, it is preferably from 3% by mass to 30% by mass.

The blending ratio in the replenishment developer is from 2 parts by mass to 50 parts by mass of the toner, and preferably from 5 parts by mass to 12 parts by mass of the toner, relative to 1 part by mass of the carrier. When the toner is less than 2 parts by mass, the amount of the carrier to be replenished is too high, and this excess supply of the carrier and the excessively high carrier concentration in the developing device tend to increase the amount of static buildup in the toner. The increase in the amount of static buildup in the toner leads to degradation of the developing ability and degradation of the image density. When the toner is greater than 50 parts by mass, the ratio of the carrier in the replenishment developer is low, and the opportunity of carrier replacement in the image forming apparatus is low, which makes it impossible to expect the effect on the carrier degradation.

In a preferred mode of the developing device of the present invention, the developer is used as packed in a storage container that can easily deform, and there is a developer replenishing device configured to supply the replenishment developer to the developing device by sucking the replenishment developer with a suction pump.

<Developer Bearer>

The developing device of the present invention includes a developer bearer.

The developer bearer is configured to have a surface thereof bear the developer thereon and endlessly move, and to develop a latent image over a surface of a latent image bearer by supplying the toner in the developer to the latent image in a developing region where the developer bearer faces the latent image bearer.

The developer bearer includes: a magnetic field generating unit including a plurality of magnetic poles; and a developing sleeve having a cylindrical shape enclosing the magnetic field generating unit, and configured to bear the developer over an outer circumferential surface of the cylindrical shape by means of a magnetic force of the magnetic field generating unit and to perform surface moving by rotating relative to a body of the developing device.

In a preferred mode of the developer bearer, the developer bearer may have, over the outer circumferential surface of the developing sleeve, a low friction surface layer of which coefficient of friction with respect to the toner is smaller than that of the material of the element tube of the sleeve forming the cylindrical shape with respect to the toner.

Specifically, the configuration of a developing roller 50, which is the developer bearer, will be described with reference to the drawings.

FIG. 19 is an expanded explanatory diagram of the developing roller 50 provided in a developing device 5.

As shown in FIG. 19, a developing sleeve 51 constituting the developing roller 50 provided in the developing device 5 includes a sleeve element tube 51*a* forming a cylindrical shape and made of a base material, and a low friction film 51*b*. The material of the sleeve element tube is preferably aluminium. The low friction film 51*b* is a low friction surface layer of which coefficient of friction with respect to the toner is smaller than that of the surface of the sleeve element tube 51 made of aluminium. The low friction surface layer is preferably made of tetrahedral amorphous carbon.

As shown in FIG. 11, the developing device 5 further includes a developing sleeve power supply 151, which is a developing sleeve voltage applying unit configured to apply a voltage in which an alternating-current component is superimposed on a direct-current component to the sleeve element tube 51*a* of the developing sleeve 51. The developing sleeve 51 that is non-magnetic but conductive can be realized with the use of aluminium in the sleeve element tube 51*a*.

<Developing Sleeve Voltage Applying Unit>

The developing device of the present invention includes a developing sleeve voltage applying unit configured to apply a voltage containing an alternating-current component to the developing sleeve. This makes it possible to reduce cyclic density variations (density unevenness).

Conditions of the developing sleeve voltage applying unit are preferably as follows, for example.

It is preferable that in the developing sleeve voltage applying unit, a bias in which an alternating-current (AC) component is superimposed on a direct-current (DC) component have a peak-to-peak relationship represented by the formula below, between a maximum value thereof (referred to as Vpp1) and minimum value thereof (referred to as Vpp2) on the regular toner charge polarity side.

$$|Vpp1-Vpp2|\leq 1{,}500\ \text{V}$$

It is preferable that in the developing sleeve voltage applying unit, a bias in which an alternating-current (AC) component is superimposed on a direct-current (DC) component have a peak-to-peak relationship represented by the formula below, among a maximum value thereof (referred to as Vpp1) and minimum value thereof (referred to as Vpp2) on the regular toner charge polarity side, and a potential (VL) of an image portion of a latent image over the latent image bearer.

$$|Vpp1|>|Vpp2|>|VL|$$

It is preferable that the duty ratio of a plus-polarity component of an alternating-current component of an AC developing bias of the developing sleeve voltage applying unit be 20% or less.

It is preferable that the frequency f of an AC developing bias of the developing sleeve voltage applying unit be 2 (kHz) or lower.

It is only necessary that the developing sleeve voltage applying unit included in the developing device of the present invention be a unit configured to apply a voltage containing an alternating-current component, as described above.

Conditions such as the duty ratio of the plus-polarity component of the alternating-current bias component, etc. are not particularly limited, and may be appropriately selected according to the purpose. For example, as long as the carrier that shows the specific volume resistivity specified in the present invention is used, the intended effect of the present invention can be achieved regardless of whether the plus-side duty ratio (which will be described in detail below) is 20% or less, or greater than 20%, for example, 30% or greater, or 50% or greater.

However, the present inventors have found it more preferable to use a developing sleeve voltage applying unit in which the plus-side duty ratio is 20% or less, in particular.

Among AC bias development waveforms, the present inventors have found an AC bias development waveform that has a low frequency, and of which component having a polarity opposite to the regular toner charge polarity has a low duty ratio. Here, an AC developing bias that shows the waveform having these properties, which can be favorably used in the present embodiment, will be referred to as "RP developing bias" expedientially, and a developing scheme of applying an RP developing bias will be referred to as "RP development" expedientially.

RP development uses a plus-side duty ratio of 20%. For example, an RP developing bias waveform having a plus-side duty ratio of 7% is shown in FIG. 8.

As compared with this, common AC development other than RP development uses a plus-side duty ratio of 30% or greater, and often around 50%. For example, an AC developing bias waveform having a plus-side duty ratio of 70% is shown in FIG. 15. The present inventors have found that use of an RP developing bias applying unit as the developing sleeve voltage applying unit leads to good results in terms of background smear, peripheral white void, and granularity, as will be shown in experimental examples 1 to 3 below.

In the present embodiment, use of RP development in particular as AC development makes it possible to suppress degradation of the developing ability for a long term while suppressing cyclic density variations (density unevenness), and to suppress background smear, generation of peripheral white void, and degradation of granularity, as will be shown in experimental examples below.

Influences of a plus-side bias arising from use of an AC developing bias, which are the subject of the present invention, are particularly remarkable with an RP developing bias. Therefore, the developing device having the configuration specified in the present invention is particularly effective in the case of a developing device employing RP development.

AD development including RP development will be described in detail in the section below describing an image forming apparatus.

(Embodiment of Image Forming Apparatus including Developing Device)

The developing device of the present invention is used when mounting an image forming apparatus with a developing unit.

The image forming apparatus includes a latent image bearer, a latent image forming unit configured to form a latent image over the latent image bearer, a developing unit configured to form a toner image by developing the latent image formed over the latent image bearer with the developer, a transfer unit configured to transfer the toner image formed over the latent image bearer to a recording medium, and a fixing unit configured to fix the toner image transferred to the recording medium thereon, and further contains other units such as a cleaning unit, a charge eliminating unit, a recycling unit, and a control unit according to necessity.

In a preferred mode, the developing unit performs development with a developer forming a magnetic brush to form a toner image.

An embodiment of a tandem color copier (hereinafter referred to as copier 500) as the image forming apparatus using the developing device of the present invention will be described below.

FIG. 9 is a schematic configuration diagram of the copier 500. The copier 500 includes a script reading unit 4 and a script conveying unit 3 above a printer unit 100 as a main body of the image forming apparatus, and includes a paper feeding unit 7 below the printer unit 100. The script conveying unit 3 conveys a script to the script reading unit 4, and the script reading unit 4 reads image information of the script conveyed thereto. The paper feeding unit 7 is a recording medium container for storing transfer sheets P, which are recording media, and includes a paper feeding cassette 26 storing transfer sheets P, and a paper feeding roller 27 configured to send forth a transfer sheet P in the paper feeding cassette 26 into the printer unit 100. An alternate long and short dash line in FIG. 9 indicates a path along which a transfer sheet P is conveyed in the copier 500.

The top portion of the printer unit 100 forms a paper ejection tray 30 on which transfer sheets P over which an output image have been formed are stacked. The printer unit 100 includes four image forming units 6 (Y, M, C, and K) as image forming unit configured to form toner images of respective colors (yellow, magenta, cyan, and black), and an intermediate transfer unit 10. The image forming units 6 (Y, M, C, and K) include drum-shaped photoconductors 1 (Y, M, C, and K), which are latent image bearers over which toner images of the respective colors are to be formed, and developing devices 5 (Y, M, C, and K), which are developing units configured to develop electrostatic latent images formed over the surface of the photoconductors 1 (Y, M, C, and K).

As shown in FIG. 9, the image forming units 6 (Y, M, C, and K) corresponding to the respective colors (yellow, magenta, cyan, and black) are arranged side by side in a manner to face an intermediate transfer belt 8 of the intermediate transfer unit 10.

The intermediate transfer unit 10 includes the intermediate transfer belt 8, and first transfer bias rollers 9 (Y, M, C, and K). The intermediate transfer belt 8 is an intermediate transfer member on which toner images of the respective colors formed over the surface of the photoconductors 1 (Y, M, C, and K) are transferred and overlaid, to form a color toner image over the surface thereof. The first transfer bias rollers 9 (Y, M, C, and K) are first transfer units configured to transfer the toner images formed over the surface of the photoconductors 1 (Y, M, C, and K) to the intermediate transfer belt 8.

The printer unit 100 includes a second transfer bias roller 19 configured to transfer the color toner image over the intermediate transfer belt 8 to a transfer sheet P. The printer unit 100 also includes a pair of registration rollers 28 configured to stop conveying of a transfer sheet P sent forth by the paper feeding roller 27 once, and adjust the timing to convey the transfer sheet P to a second transfer nip at which the intermediate transfer belt 8 and the second transfer bias roller 19 face each other. The printer unit 100 also includes a fixing device 20 configured to fix an unfixed toner image over the transfer sheet P above the second transfer nip.

There are toner containers 11 (Y, M, C, and K) for the respective colors in the printer unit 100 below the paper ejection tray 30 and above the intermediate transfer unit 10. The toner containers 11 (Y, M, C, and K) for the respective colors store toners of the respective colors (yellow, magenta, cyan, and black) to be supplied to the respective developing devices 5 (Y, M, C, and K).

FIG. 10 is an expanded explanatory diagram of one of the four image forming units 6 (Y, M, C, and K).

The four image forming units 6 (Y, M, C, and K) set in the printer unit 100 have substantially the same configuration and operation, except that they use toners of different colors in an image forming process. Hence, the signs "Y, M, C, and K" indicating the corresponding colors will be omitted in the following description and the drawings referred to in the description, where appropriate.

As shown in FIG. 10, the image forming unit 6 is a process cartridge in which the photoconductor 1 and the developing device 5 are supported in an integrated state. The process cartridge is attachable to and detachable from the body of the copier 500. This facilitates replacement of the developing device 5 in the body of the copier 500 mounted with the developing device 5, and improves the convenience of maintenance of the copier 500.

As shown in FIG. 10, the image forming unit 6 includes the developing device 5, a photoconductor cleaning device 2, a lubricant applying device 4, and a charging device 40 around the photoconductor 1 (FIG. 9 shows only the developing device 5 as the device around the photoconductor 1). In the image forming unit 6 of the present embodiment, the photoconductor cleaning device 2 is configured to perform cleaning with a cleaning blade 2*a*, and the charging device 40 is configured to perform charging with a charging roller 4*a*.

During image formation, an image forming process (a charging step, an exposure step, a developing step, a transfer step, and a cleaning step) is performed over the photoconductor 1, and a desired toner image is formed over the photoconductor 1. In the present embodiment, the photoconductor 1, the charging device 40, the developing device 5, and the photoconductor cleaning device 2 are integrated as the image forming unit 6, which is a process cartridge to be set in the apparatus body of the copier 500 attachably and detachably. The image forming unit may also be configured such that the photoconductor 1, the charging device 40, the developing device 5, and the photoconductor cleaning device 2 can be set in the body of the image forming apparatus attachably and detachably individually. With this configuration, each device is individually replaced with new one when its life expires.

A normal color image forming operation of the copier 500 of the present embodiment will be described below.

First, when an unillustrated start button is pressed in a state that a script is set on the script table of the script conveying unit 3, the script is conveyed from the script table and placed over a contact glass of the script reading unit 4 by a conveying roller of the script conveying unit 3. The script reading unit 4 optically reads the image information of the script placed over the contact glass.

Specifically, the script reading unit 4 scans the image of the script over the contact glass by irradiating the script with light emitted by an illumination lamp. Then, the script reading unit 4 passes light reflected from the script through a series of minors and lenses in order for the light to be imaged over a color sensor. Color image information of the script is read by the color sensor as each chromatically decomposed light of RGB (red, green, or blue), which is then converted to an electric image signal. Then, an image processing unit performs processes such as a color conversion process, a chromatic compensation process, a spatial frequency correction process, etc. based on the RGB chromatically decomposed image signals, and obtains color image information for yellow, magenta, cyan, and black.

The image information for each of yellow, magenta, cyan, and black is sent to an unillustrated exposure device. Then, the exposure device emits laser light L based on the image information of the respective colors to the corresponding photoconductors 1 (Y, M, C, and K).

Meanwhile, the four photoconductors 1 (Y, M, C, and K) are driven to rotate in the clockwise direction of FIG. 9 and FIG. 10 by an unillustrated driving unit. Then, the surfaces of the photoconductors 1 (Y, M, C, and K) are electrically charged uniformly in the region where the photoconductors face the charging roller 4*a* of the charging device 40 (a charging step). As a result, a charged potential is formed over the surfaces of the photoconductors 1 (Y, M, C, and K). After this, the electrically charged surfaces of the photoconductors 1 (Y, M, C, and K) reach the positions at which they are irradiated with laser light L emitted by the unillustrated exposure device.

In the exposure device, four light sources emit laser light L corresponding to the image signals in a manner to correspond to the respective colors. Each laser light L passes along each different light path for each of the color components of yellow, magenta, cyan, and black, and irradiates the surface of each photoconductor 1 (Y, M, C, and K) (an exposure step).

The exposure step will be described by taking yellow for example. Laser light L corresponding to the yellow component irradiates the surface of the yellow photoconductor 1Y that is at the first order counted from the left-hand side of the sheet of FIG. 9. At the time, the laser light L for the yellow component is scanned over the yellow photoconductor 1Y in a direction along the axis of rotation of the photoconductor (a main scanning direction), by a polygon minor rotating at a high speed. By the laser light L being scanned in this way, an electrostatic latent image corresponding to the yellow component is formed over the surface of the yellow photoconductor 1Y that has been electrically charged by the charging device 40.

Likewise, laser light L corresponding to the magenta component irradiates the surface of the magenta photoconductor 1M that is at second order counted from the left-hand side of the sheet of FIG. 9, to form an electrostatic latent image corresponding to the magenta component. Laser light L corresponding to the cyan component irradiates the surface of the cyan photoconductor 1C that is at the third order counted from the left-hand side of the sheet of FIG. 9, to form an electrostatic latent image corresponding to the cyan component. Laser light L corresponding to the black component irradiates the surface of the black photoconductor 1K that is at the fourth order counted from the left-hand side of the sheet of FIG. 9, to form an electrostatic latent image corresponding to the black component.

After this, the surfaces of the photoconductors 1 (Y, M, C, and K) over which the electrostatic latent images of the respective colors are formed reach the positions at which they face the developing devices 5. At the facing positions, the developing devices 5 (Y, M, C, and K) storing the developers containing toners of the respective colors and a carrier supply the toners of the respective colors to the latent images over the surfaces of the photoconductors 1 (Y, M, C, and K) and develop the latent images over the photoconductors 1 (Y, M, C, and K) (a developing step). As a result, desired toner images are formed over the photoconductors 1 (Y, M, C, and K).

The surfaces of the photoconductors 1 (Y, M, C, and K) that have passed through the positions at which they face the developing devices 5 reach the positions at which they face the intermediate transfer belt 8. At the respective facing positions, the first transfer bias rollers 9 (Y, M, C, and K) are set in a manner to abut on the internal circumferential surface of the intermediate transfer belt 8. The photoconductors 1 (Y, M, C, and K) and the first transfer bias rollers 9 (Y, M, C, and K) form first transfer nips by facing each other via the intermediate transfer belt 8. Then, at the first transfer nips, the toner images of the respective colors formed over the photoconductors 1 (Y, M, C, and K) are transferred sequentially to the intermediate transfer belt 8 and overlaid (a first transfer step). At the time, untransferred toners remain over the surfaces of the photoconductors 1, although slightly.

The surfaces of the photoconductors 1 that have been passed through the first transfer nips reach the positions at which they face the photoconductor cleaning devices 2, respectively. At the positions at which the surfaces face the photoconductor cleaning devices 2, the untransferred toners remaining over the photoconductors 1 are scraped off and collected by the cleaning blades 2*a* (a photoconductor cleaning step).

The surfaces of the photoconductors 1 that have passed through the positions at which they face the photoconductor cleaning devices 2 reach charge elimination positions at which they face unillustrated charge eliminating units. At the positions, residual charges over the surfaces of the photoconductors 1 are eliminated. In this way, the series of the image forming process performed over the surfaces of the photoconductors 1 is completed, and the next image forming operation is on standby.

As described above, the image forming process is performed by the respective four image forming units 6 (Y, M, C, and K). That is, laser light L based on image information is emitted toward the photoconductors 1 of the respective image forming units 6 (Y, M, C, and K) by the unillustrated exposure device disposed below the four image forming units 6 in FIG. 9. Specifically, the exposure device emits laser light L from the light sources, and irradiates the surfaces of the photoconductors 1 with the laser light L through a plurality of optical elements while scanning the laser light L with a polygon mirror that is driven to rotate. After this, toner images of the respective colors formed over the surfaces of the respective photoconductors 1 through the developing step are transferred to the intermediate transfer belt 8 and overlaid together. In this way, a color image is formed over the intermediate transfer belt 8.

As described above, the four first transfer bias rollers 9 (Y, M, C, and K) form first transfer nips by holding the intermediate transfer belt 8 between themselves and the photoconductors 1 (Y, M, C, and K). A transfer bias having an opposite polarity to that of the toner is applied to the first transfer bias rollers 9 (Y, M, C, and K).

The intermediate transfer belt 8 performs surface moving in the direction of the arrow in FIG. 9 and passes the first transfer nips of the first transfer bias rollers 9 (Y, M, C, and K) sequentially. In this way, the toner images of the respective colors over the photoconductors 1 (Y, M, C, and K) are firstly transferred to the intermediate transfer belt 8 and overlaid.

The intermediate transfer belt 8 bearing a color toner image resulting from the toner images of the respective colors over the four photoconductors 1 (Y, M, C, and K) having been transferred and overlaid thereon performs surface moving in the counterclockwise direction in FIG. 9 and reaches the position at which it faces the second transfer bias roller 19. At the facing position, a second transfer nip is formed by a second transfer backup roller 12 holding the intermediate transfer belt 8 between itself and the second transfer bias roller 19.

Meanwhile, a transfer sheet P fed by the paper feeding roller 27 from the paper feeding cassette 26 storing transfer sheets P is guided to the pair of registration rollers 28 after having passed a conveying guide, and stops once by hitting against the pair of registration rollers 28. The transfer sheet P having hit against the pair of registration rollers 28 is conveyed to the second transfer nip synchronously with the timing at which the color toner image formed over the intermediate transfer belt 8 comes to the second transfer nip.

Specifically, a plurality of transfer sheets P, which are receiving members, are stored in a stacked state in the paper feeding cassette 26. When the paper feeding roller 27 is driven to rotate in the counterclockwise direction in FIG. 9, the topmost transfer sheet P is fed toward the roller nip of the pair of registration rollers 28. The transfer sheet P conveyed to the pair of registration rollers 28 once stops at the position of the roller nip of the pair of registration rollers 28 that are stopped being driven to rotate. Then, the pair of registration rollers 28 are driven to rotate at a timing synchronous with the color image over the intermediate transfer belt 8, and the transfer sheet P is conveyed toward the second transfer nip.

Then, the color toner image formed over the intermediate transfer belt 8 is transferred to the transfer sheet P at the second transfer nip, and the desired color image is formed over the transfer sheet P (a second transfer step). At the time, an untransferred toner, which has not been transferred to the transfer sheet P, remained over the intermediate transfer belt 8.

The surface of the intermediate transfer belt 8 having passed through the second transfer nip reaches the position at which it faces an unillustrated intermediate transfer belt cleaning device. At the facing position, the untransferred toner adhered to the intermediate transfer belt 8 is collected by the intermediate transfer belt cleaning device, and the surface of the intermediate transfer belt 8 is restored to the initial state. In this way, the series of the transfer process performed over the surface of the intermediate transfer belt 8 is completed.

Meanwhile, the transfer sheet P to which the color toner image has been transferred at the second transfer nip is conveyed to the fixing device 20. The fixing device 20 fixes the color toner image over the transfer sheet P by heat and pressure at a fixing nip formed by a fixing roller and a pressuring roller (a fixing step).

The transfer sheet P having passed through the fixing device 20 is ejected to the outside of the printer unit 100 through between rollers of a pair of paper ejection rollers 25. The transfer sheet P having been ejected to the outside of the apparatus body of the copier 500 is stacked sequentially over the paper ejection tray 30 as an output image.

In this way, the series of the image forming process of the copier 50 as the image forming apparatus is completed.

Next, the configuration and operation of the developing device 5 included in the image forming unit 6 will be explained more specifically with reference to FIG. 11, FIG. 12, FIG. 13-A, FIG. 13-B, and FIG. 13-C.

FIG. 11 is an explanatory diagram of the developing device 5 of the present embodiment. FIG. 11 is a diagram explaining a cross-section of the developing device 5. The developing device 5 includes a casing 58 as a development casing for storing a developer. The casing 58 is constituted by a development lower case 58*a*, a development upper case 58*b*, and a development cover 58*c*.

FIG. 12 is a perspective explanatory diagram of the developing device 5 in a state that the development cover 58*c* is removed.

FIG. 13-A to FIG. 13-C are explanatory diagrams of the developing device 5. FIG. 13-A is a top view of the developing device 5 shown in FIG. 12 in the state that the development cover 58*c* is removed. FIG. 13-B is a side elevation of the developing device 5 seen from the direction of the arrow "A" shown in FIG. 12. FIG. 13-C is a sectional side elevation of the developing device 5 seen from the direction of the arrow "A" shown in FIG. 12.

The developing device 5 includes the developing roller 50, which is a developer bearer facing the photoconductor 1, a supplying screw 53, which is a supplying/conveying member, a collecting screw 54, which is a collecting/conveying member, a doctor blade 52, which is a developer regulating member, and a divider member 57. The supplying screw 53 and the collecting screw 54 are screw members obtained by providing a spiral blade about a rotation shaft, and are configured to convey a developer G in the axial direction of the rotation shaft by rotating.

The casing 58 has a development opening 58*e* as an opening in order for the surface of the developing roller 50 to be exposed partially at the developing region where the developing roller 50 faces the photoconductor 1.

The doctor blade 52 is disposed to face the surface of the developing roller 50, and configured to regulate the amount of the developer G borne over the surface of the developing roller 50.

The supplying screw 53 and the collecting screw 54 are a plurality of conveying members that are configured to stir and convey the developer G stored in the developing device 5 and form a cycling path. Of the plurality of conveying members, the supplying screw 53 is disposed to face the developing roller 50, and configured to supply the developer G to the developing roller 50 while conveying the developer G in the longer direction thereof, whereas the collecting screw 54 is configured to convey the developer G while mixing and stirring it with a toner supplied.

In the space inside the casing 58 of the developing device 5, a supplying/conveying path 53*a* in which the supplying screw 53 is disposed and a collecting/conveying path 54*a* in which the collecting screw 54 is disposed are spatially separated by the divider member 57. The divider member 57 is disposed such that an end portion thereof in a cross-section thereof taken orthogonally to the axial direction (i.e., a cross-section shown in the explanatory diagram of FIG. 11) faces the surface of the developing roller 50 in proximity to the surface, and is thereby configured to function also as a separating blade promoting separation of the developer G from the surface of the developing roller 50. The function of the divider member 57 as the separating blade prevents the developer G having passed the developing region from reaching the supplying/conveying path 53*a*, and makes it possible for the developer G to move into the collecting/conveying path 54*a* without being stalled.

As shown in FIG. 11, the developing roller 50 includes: a magnet roller 55 constituted by a plurality of magnets fixed thereinside; and a developing sleeve 51 configured to rotate over the circumference of the magnet roller 55. The developing sleeve 51 is a member made of a non-magnetic material and having a cylindrical shape enclosing the magnet roller 55 thereinside and rotatable when necessary. As a plurality of magnetic poles, a first magnetic pole P1 (S pole), a second magnetic pole P2 (N pole), a third magnetic pole P3 (S pole), a fourth magnetic pole P4 (N pole), and a fifth magnetic pole P5 (N pole) are formed over the surface of the developing sleeve 51 by the magnet roller 55. By the developing sleeve 51 rotating over the circumference of the magnet roller 55 forming the five magnetic poles, the developer G moves over the developing roller 50 along with the rotation. In FIG. 11, each of "P1" to "P5" represents the distribution of the magnetic flux density (absolute value) of the magnetic field formed over the surface of the developing sleeve 51 by each magnetic pole in the direction normal to the surface of the developing sleeve 51.

The developing device 5 stores the two-component developer G containing a toner and a carrier (including also the case where additives, etc. are added) in the space formed by the casing 58 (in the supplying/conveying path 53*a* and the collecting/conveying path 54*a*). The developing device 5 includes the supplying screw 53 and the collecting screw 54, which are the developer conveying members configured to convey the developer G in the longer direction thereof (in the axial direction of the axis of rotation of the developing sleeve 51) and form a cycling path. In the developing device 5, the supplying/conveying path 53*a* and the collecting/conveying path 54*a* are formed by the divider member 57 disposed between the supplying screw 53 and the collecting screw 54. The developing device 5 includes an unillustrated toner concentration sensor configured to detect the toner concentration in the developer G stored in the supplying/conveying path 53*a* or the collecting/conveying path 54*a*.

The doctor blade 52 is disposed below the developing roller 50 at a position that is upstream, in the surface moving direction of the developing sleeve 51, from the developing region where the photoconductor 1 and the developing sleeve 51 face each other, to regulate at this position, the amount of the developer borne over the surface of the developing sleeve 51 and advancing to the developing region.

The developing device 5 uses the two-component developer G. Therefore, a toner is supplied into the developing device 5 through a toner supply port 59 provided at a portion of the developing device in accordance with the toner consumption in the developing device 5. The supplied toner is stirred and mixed with the developer G in the developing device 5 while being conveyed by the collecting screw 54 and the supplying screw 53, which are the developer conveying members. The developer G stirred and mixed by the developer conveying member in this way is partially supplied to the surface of the developing sleeve 51, which is the developer bearer, and borne over the surface thereof. The developer G borne over the surface of the developing sleeve 51 reaches the developing region after being regulated to an appropriate amount by the doctor blade 52 disposed below the developing sleeve 51. At the developing region, the toner contained in the developer G over the surface of the developing sleeve 51 attaches to the latent image over the surface of the photoconductor 1.

The developing device 5 of the present embodiment is filled with a predetermined amount of the developer G. The developer G is one that is described above. By the supplying screw 53 and the collecting screw 54 arranged in parallel being rotated at from 600 [rpm] to 800 [rpm], the developer G is conveyed, and the toner and the carrier are mixed with each other so that the toner can be charged. Further, by the supplying screw 53 and the collecting screw 54 being rotated, a brand-new toner supplied from the toner supply port 59 is stirred in the developer G and mixed such that the percentage of the toner content in the developer G is uniform.

The uniformly mixed developer G is passed over to the outer circumferential surface of the developing sleeve 51 by the magnetic force of the fifth magnetic pole P5 of the magnet roller 55 enclosed within the developing sleeve 51 while being conveyed by the supplying screw 53, which is disposed in proximity to and in parallel with the developing sleeve 51, in the longer direction of the supplying screw 53. The developer G passed over to the surface of the developing sleeve 51 reaches the developing region by the developing sleeve 51 rotating in the counterclockwise direction as indicated by the arrow in FIG. 11.

Upon application of a developing voltage to the developing sleeve 51 by the developing sleeve power supply 151 which is to be specifically described below, a developing electric field is formed between the developing sleeve 51 and the photoconductor 1 at the developing region. By this developing electric field, the toner contained in the developer G over the surface of the developing sleeve 51 is supplied to the latent image over the surface of the photoconductor 1, and the latent image over the photoconductor 1 is developed in the developing region.

The developer G over the surface of the developing sleeve 51 that has passed the developing region is collected into the collecting/conveying path 54*a* in the developing device 5 along with the rotation of the developing sleeve 51. Specifically, the developer G separating from the surface of the developing sleeve 51 falls onto and slides down over the upper surface of the divider member 57, and is collected by the collecting screw 54.

The arrows in FIG. 13-A and FIG. 13-C indicate the flow of the developer G in the developing device 5. The arrow "a" in FIG. 13-A and FIG. 13-C indicates the flow of the developer G conveyed by the collecting screw 54 in the collecting/conveying path 54*a*. The arrows "b" in FIG. 13-A indicate the flow of the developer G borne over the developing sleeve 51 and conveyed into the collecting/conveying path 54*a*. The arrow "c" in FIG. 13-C indicates the flow of the developer G conveyed by the supplying screw 53 in the supplying/conveying path 53*a*.

As shown in FIG. 13-C, the upper collecting/conveying path 54*a* and the lower supplying/conveying path 53*a* communicate with each other vertically, in a collecting screw downstream end region α and a supplying screw downstream end region β, which are regions at the axial-direction end portions of the supplying screw 53 and the colleting screw 54. The developer G is conveyed from the upper collecting/conveying path 54*a* to the lower supplying/conveying path 53*a* in the collecting screw downstream end region α, and from the lower supplying/conveying path 53*a* to the upper collecting/conveying path 54*a* in the supplying screw downstream end region β. In the collecting screw downstream end region α and the supplying screw downstream end region β, which are the communicating regions, the screws are equipped with a paddle or a reversely wound screw, to have a shape capable of conveying in the direction perpendicular to the conveying direction.

FIG. 14 is a schematic diagram showing the move of the developer g in the longer direction (axial direction) and the state of accumulation of the developer G in the developing device 5. The outlined arrows in FIG. 14 indicate the flow of the developer G in the developing device 5. As shown in FIG. 13-C, openings (an agent uplifting port 72 and an agent fall-down port 71) through which the supplying/conveying path 53*a* and the collecting/conveying path 54*a* communicate with each other are provided at both ends of the divider member 57 (omitted in FIG. 14) in the longer direction of the developing device 5, respectively.

As shown in FIG. 14, the developer G having reached the end of the supplying/conveying path 53*a* at the downstream side in the conveying direction of the supplying screw 53 is passed over to the conveying-direction upstream end of the collecting/conveying path 54*a* through the agent uplifting port 72, which is one of the openings provided in the divider member 57, as indicated by the arrow "d". On the other hand, the developer G having reached the end of the collecting/conveying path 54*a* at the downstream side in the conveying direction of the collecting screw 54 is passed over to the conveying-direction upstream end of the supplying/conveying path 53*a* through the agent fall-down port 71, which is one of the openings provided in the divider member 57, as shown by the arrow "e".

FIG. 14 shows that some distance is present between the supplying/conveying path 53*a* and the collecting/conveying path 54*a*, for the purpose of exemplarily showing supplying and collecting of the developer G to and from the developing sleeve 51. However, the supplying/conveying path 53*a* and the collecting/conveying path 54*a* are partitioned by the plate-shaped divider member 57 as shown in FIG. 11 and FIG. 13-C, and the agent uplifting port 72 and the agent fall-down port 71, which are the openings in the divider member 57, are through-holes that go through the divider member 57 from the one side thereof to the back side thereof.

As shown in FIG. 14, the developer G in the supplying/conveying path 53*a* below the collecting/conveying path 54*a* is uplifted to the surface of the developing sleeve 51 while being conveyed by the supplying screw 53 in the longer direction. At the time, the developer G is uplifted to the surface of the developing sleeve 51 by the rotation of the supplying screw 53 and the magnetic force of the fifth magnetic pole P5 functioning as an uplifting magnetic pole. The developer G over the surface of the developing sleeve 51 that has passed through the developing region after being uplifted to the surface of the developing sleeve 51 is separated from the surface of the developing sleeve 51 and sent into the collecting/conveying path 54*a*. At the time, the developer G over the surface of the developing sleeve 51 is separated from the surface of the developing sleeve 51 by the effect of the magnetic force of an agent separating magnetic pole constituted by the fourth magnetic pole P4 and the fifth magnetic pole P5, which are adjacent magnetic poles having the same polarity (N poles), and by the effect of the divider member 57 functioning as the separating blade.

The developing device 5 forms repulsive magnetic forces at the agent separating magnetic pole constituted by the fourth magnetic pole P4 and the fifth magnetic pole P5. The developer G conveyed to the section in which the repulsive magnetic forces are formed is released in a direction of a resultant of the normal direction and the rotation tangent direction at the agent separating magnetic pole, falls onto the divider member 57 by its own weight, and is collected.

The collecting screw 54 in the collecting/conveying path 54*a* located above the supplying/conveying path 53*a* conveys the developer G, which has been separated from the developing sleeve 51 at the position of the agent separating magnetic pole, in the longer direction thereof (in a reverse direction from the conveying direction by the supplying screw 53).

The downstream side of the supplying/conveying path 53*a*, which is the conveying path by the supplying screw 53, and the upstream side of the collecting/conveying path 54*a*, which is the conveying path by the collecting screw 54, communicate with each other through the agent uplifting port 72. The developer G that has reached the downstream end of the supplying/conveying path 53*a* stays at this position, is pushed upward by the developer G conveyed there afterwards, and reaches the upstream end of the collecting/conveying path 54*a*.

The toner supply port 59 is provided at the upstream end of the collecting/conveying path 54*a*, and a brand-new toner is supplied where necessary, from the toner container 11 through an unillustrated toner supply device. The upstream end of the supplying/conveying path 53*a* and the downstream end of the collecting/conveying path 54*a* communicate with each other through the agent fall-down port 71. The developer G that has reached the downstream end of the collecting/conveying path 54*a* falls down the agent fall-down port 71 by its own weight and is passed over to the upstream end of the supplying/conveying path 53*a*.

As described above, the developing device 5 rotates the supplying screw 53 and the collecting screw 54 in the directions indicated by the arrows in FIG. 11, and has the developer G attracted to the developing sleeve 51 by the magnetic attractive force of the magnet roller 55 enclosed within the developing sleeve 51. Furthermore, the developing device 5 uplifts and supplies the developer G continuously to the developing region by rotating the developing sleeve 51 at a predetermined speed ratio relative to the photoconductor 1.

The developing device 5 employs the system of supplying the developer G to the developing sleeve 51 while stirring and conveying the developer G in the supplying/conveying path 53*a* by the supplying screw 53, and collecting the developer G that has been supplied to the developing sleeve 51 fully to the collecting screw 54. Hence, the amount of the developer G is lower where closer to the downstream side in the conveying direction of the supplying screw 53 in the supplying/conveying path 53*a*, and the accumulation state of the developer G in the supplying/conveying path 53*a* is slanted as shown in FIG. 14.

Here, the developer conveying capacity of the supplying screw 53 that can be calculated based on the diameter of the blades of the supplying screw 53, the pitch of the blades, the rotation speed, etc. is referred to as "Wm", and the developer conveying capacity over the developing sleeve 51 is referred to as "Ws". In this case, when "Wm" and "Ws" are in a relationship "Wm>Ws", the developer G will be conveyed to the surface of the developing sleeve 51 uniformly. Unless this condition is established, the developer G will be short at the downstream side in the conveying direction of the supplying screw 53 in the supplying/conveying path 53*a*, and the developer G cannot be supplied to the developing sleeve 51 at the downstream side. Hence, it is necessary to set the developer conveying capacity of the supplying screw 53 higher than the conveying amount of the developer G over the developing sleeve 51.

The developing device 5 collects the developer G from the developing sleeve 51 into the collecting/conveying path 54*a*. At the time, any developer G that cannot be collected because the developer G in the collecting/conveying path 54*a* is bulky enters the supplying/conveying path 53*a* through the gap between the divider member 57 and the developing sleeve 51, and is supplied again to the surface of the developing sleeve 51 without being stirred sufficiently by the supplying screw 53. In this case, the insufficiently stirred developer G reaches the developing region, forming a cause of generation of a defective image. Hence, it is also necessary to set the developer conveying capacity of the collecting screw 54 higher than the conveying amount of the developer G over the developing sleeve 51.

As above, it is necessary to set the developer conveying capacities of the supplying screw 53 and collecting screw 54 higher than the conveying amount of the developer G over the developing sleeve 51, which inevitably requires high-speed rotation settings for the screws.

Next, a developing bias applied to the developing sleeve 51 of the developing device 5 will be described.

In the present invention, a developing bias is usable as long as it is an AC developing bias. However, among such AC developing biases, it is more preferable to use an RP developing bias.

Hence, a developing bias Vb to be applied by the developing sleeve power supply 151 to the developing sleeve 51 of the developing device 5 will be described with reference to FIG. 8 showing an RP developing bias waveform.

In the explanatory diagram shown in FIG. 8, "GND" indicates an earth voltage, which is "0 [V]". Higher positions in FIG. 8 indicate higher values on the minus-polarity side, and lower positions in FIG. 8 indicate higher values on the plus-polarity side. "T" in FIG. 8 indicates 1 [cycle] of the developing bias Vb that changes its voltage cyclically due to an alternating-current component. "T1" in FIG. 8 indicates the time length for which the voltage of a plus polarity-side component is applied during 1 [cycle] of the developing bias Vb. "T2" in FIG. 8 indicates the time length for which the voltage of a minus polarity-side component is applied during 1 [cycle] of the developing bias Vb.

The developing bias Vb of the present embodiment shown in FIG. 8 is a voltage containing an alternating-current component having a frequency (1/T) of 2.0 [kHz] or lower. In the developing bias Vb, the duty ratio (T1/T×100, hereinafter referred to as "plus-side duty ratio") of the component of which polarity (plus polarity) is opposite to the regular toner charge polarity (minus polarity) is 20 [%] or less, and the difference between the maximum value (referred to as Vpp1) on the regular toner charge polarity side, i.e., the highest value (Vpp1) seen from the minus side on the minus-polarity side of the developing bias Vb, and the minimum value (referred to as Vpp2) on the regular toner charge polarity side, i.e., the lowest value (Vpp2) seen from the minus side on the minus-polarity side of the developing bias Vb is 1,500 [V] or smaller. Here, the minimum value on the regular toner charge polarity side is a value that is closest to 0 [V] when the surface potential of the developing sleeve 51 fluctuates only on the minus-polarity side, and is a value that is the maximum value on the plus-polarity side when the surface potential fluctuates also on the plus-polarity side.

The plus-side duty ratio is the ratio of the time length for which a component of the AC bias that is on the plus-polarity side of an exposed potential VL is applied, and is a value obtained by dividing the time length (T1) for which the voltage on the plus-polarity side is applied during one cycle of the AC bias, by the time length (T) of one cycle of the AC bias. For as long as the voltage on the plus-polarity side of the exposed potential VL is applied, an electric field that works to draw the toner attached to an electrostatic latent image over the photoconductor 1 back to the developing sleeve 51 is formed.

Frequency indicates how many cycles of waves are present per second, and is represented by "1/T", where "T" indicates the time length of one cycle.

In the example of the waveform shown in FIG. 8, the frequency is 1 [kHz], the plus-side duty ratio is 7 [%], the peak-to-peak value Vpp, which represents the difference between the maximum value and minimum value of the developing bias Vb is 1,000 [V].

"Vbav" in FIG. 8 indicates the average value of the developing bias Vb (hereinafter referred to as "developing bias average value" or also as Voff). In the example shown in FIG. 8, the developing bias average value is −500 [V]. A charged potential Vd is a value that is on the minus-polarity side of Vbav with a difference of ΔV3. The exposed potential VL is −100 [V]. The minus-side upper limit value of the developing bias Vb is a value that is on the minus-polarity side of the charged potential Vd with a difference of ΔV1 shown in FIG. 8. The minus-side upper limit value of the developing bias Vb is a value that is on the minus-polarity side of the developing bias average value Vbav with a difference of ΔV2 shown in FIG. 8. "ΔV2=ΔV1+ΔV3" is established.

The minus-side lower limit value (i.e., the plus-side upper limit value) of the developing bias Vb is a value that is on the plus-polarity side of the exposed potential VL with a difference of ΔV4 shown in FIG. 8. The minus-side lower limit value (i.e., the plus-side upper limit value) of the developing bias Vb is a value that is on the plus-polarity side of the developing bias average value Vbav with a difference of ΔV5 shown in FIG. 8.

In the example shown in FIG. 8, the developing potential Vpot, which is the potential difference between the developing bias average value Vbav and the exposed potential VL is 400 [V].

It is only necessary that the developing device of the present invention use an AC developing bias in the developing sleeve voltage applying unit. The developing device may include the developing sleeve voltage applying unit that is not limited to RP development in which the plus-side duty ratio described above is 20% or less, but may use an AC developing bias having a plus-side duty ratio of greater than 20%, e.g., an AC developing bias having a plus-side duty ratio of 30% or greater, or 50% or higher. In the present invention, an AC developing bias having a plus-side duty ratio of 70% as shown in FIG. 15 may also be used.

In the waveform of the developing bias Vb for Ac bias development shown in FIG. 15, the frequency is 9 [kHz], the plus-side duty ratio (T1/T×100) is 70 [%], and the peak-to-peak value Vpp, which is the difference between the maximum value and minimum value of the developing bias Vb, is 1,500 [V]. In the waveform shown in FIG. 15, the developing bias average value Vbav is −300 [V], and the exposed potential VL is −100 [V].

In the example shown in FIG. 15, the developing potential Vpot is 200 [V].

The time length for which the voltage on the plus-polarity side of the exposed potential VL is applied is considerably shorter, and the time length for which the voltage on the minus-polarity side of the exposed potential VL is applied is longer in the waveform of the RP developing bias shown in FIG. 8 than in the waveform of the AC developing bias shown in FIG. 15. Specifically, in the AC bias development in which the regular toner charge polarity is the minus polarity, the plus-side duty ratio is typically 30 [%] or higher (70 [%] in the waveform shown in FIG. 15). On the other hand, in the waveform of the RP developing bias, the plus-side duty ratio is 7 [%], which is 20 [%] or less.

In the AC bias development, a high-frequency waveform is mainly used, like the frequency of the waveform shown in FIG. 15 is 9 [kHz]. On the other hand, the frequency of the RP waveform is 990 [Hz], which is 2 [kHz] or lower.

In this way, the waveform of the RP developing bias has a lower frequency and a smaller duty ratio for the component having a polarity opposite to the regular toner charge polarity, than has the waveform of the typical AC developing bias known so far.

The present inventors have performed image formation using the RP development, and as a result, confirmed that the RP development could suppress density unevenness due to the rotation cycle of the developing sleeve 51, and could also suppress generation of peripheral white void and degradation of granularity. The present inventors have performed image formation by changing only the conditions of the developing bias to be applied to the developing sleeve 51, and as a result, could obtain improvement over the typical AC bias development in terms of granularity, which was a comparable level of granularity to that obtained by DC bias development.

The developing bias average value Vbav in the RP development shown as an example in FIG. 8 and the AC bias development shown as an example in FIG. 15 corresponds to a developing bias Vb in the DC bias development. Hence, when the potential of the surface of the photoconductor 1 is on the lower side, i.e., on the plus-polarity side of the developing bias average value Vbav in FIG. 8 and FIG. 15, the toner moves from the developing sleeve 51 to the surface of the photoconductor 1 and is developed. When the potential of the surface of the photoconductor 1 is on the upper side, i.e., on the minus-polarity side of the developing bias average value Vbav, the toner does not move from the developing sleeve 51 to the surface of the photoconductor 1, and is not developed.

Hence, as long as the developing bias average value Vbav is lower than the charged potential Vd and higher than the exposed potential VL in the minus-polarity region (Vd>Vbav>VL), the electrostatic latent image over the photoconductor 1 can be developed.

The exposed potential VL may be in the range of from 0 [V] to ±100 [V], as in the conventional image forming apparatuses. In the examples shown in FIG. 8 and FIG. 15, the exposed potential VL is −100 [V].

Further, the RP development using a low frequency can suppress generation of peripheral white void that is generated in AC bias development using a high frequency. Furthermore, the RP development using a small plus-side duty ratio can suppress degradation of granularity that occurs in AC bias development using a low frequency and a high plus-side duty ratio.

The potential of the developing sleeve 51 and the potential of the photoconductor 1 will now be described. In typical electrophotography, the photoconductor 1 is electrically charged uniformly by the charging unit, an electrostatic latent image is formed over the surface of the photoconductor 1 by the exposure unit, and a toner image is formed with the electrostatic latent image over the surface of the photoconductor 1 developed with the toner contained in the developer borne over the developing sleeve 51. Here, a potential that is higher, on the regular toner charge polarity side (on the minus-polarity side in the present embodiment), than the potential of the electrostatic latent image formed by exposure is applied to the developing sleeve 51, which forms a potential difference by which the toner is moved and developed from the developing sleeve 51 to the electrostatic latent image over the photoconductor 1.

In DC bias application, the voltage applied to the developing sleeve 51 is constant, and the potential of the surface of the developing sleeve 51 is constant. Therefore, there is only such a potential difference between the developing sleeve 51 and the electrostatic latent image over the photoconductor 1, by which the toner is moved from the developing sleeve 51 to the electrostatic latent image.

On the other hand, in AC bias application to the developing sleeve 51, a potential difference by which the toner is developed from the developing sleeve 51 to the photoconductor 1 and a potential difference by which the toner is drawn back to the developing sleeve 51 are alternately formed in a minute time with respect to the electrostatic latent image. The reason why the toner can be developed to the electrostatic latent image in spite of the fact that a potential difference by which the toner is drawn back from the photoconductor 1 to the developing sleeve 51 is also formed is as follows. That is, the potential difference between the average potential of the AC bias and the potential of the electrostatic latent image over the photoconductor 1 is such a potential difference as enough for the toner to be moved to the photoconductor 1.

AC bias application has a greater effect than DC bias application has in terms of suppressing density unevenness. This is considered to be because drawing back the toner from the photoconductor 1 to the developing sleeve 51 and moving it again to the photoconductor 1 can make the amount of toner accumulation over the photoconductor 1 uniform, and the density difference on the image smaller. As the result of earnest studies, the present inventors have found that a greater effect of suppressing density unevenness is exhibited with a higher frequency of the AC bias or a greater peak-to-peak value (i.e., a value indicating the difference between the maximum value and minimum value of the developing bias).

However, as the result of further studies, the present inventors have found the followings.

That is, at a higher frequency accompanied by a greater effect of drawing back the toner, a white void is likely to be generated about the boundary between a high-density portion and a low-density portion (hereinafter referred to as "peripheral white void"). It is desirable to set the frequency of the AC bias to 2 [kHz] or lower to suppress this peripheral white void.

Furthermore, a greater peak-to-peak value leading to a greater move of the toner with a greater effect of suppressing density unevenness however makes it more likely for the toner to be attached to a non-image portion over the photoconductor 1 (background smear) at the same time. Hence, the peak-to-peak value is preferably 1,500 [V] or smaller.

Under these conditions, granularity degradation (flakiness) may occur over the image due to the toner drawing-back effect of the AC bias. To suppress the granularity degradation, it is preferable that the plus-side duty ratio, which indicates the ratio of the time length for which a voltage on the opposite polarity side to the electrostatic polarity of the toner, to the time length of one cycle of the AC bias, be 20 [%] or less.

Experimental examples exploring the appropriate conditions for the peak-to-peak value, and the frequency and plus-side duty ratio of the AC bias will be described below.

Experimental Example 1

In the experimental example 1, an upper limit value of the peak-to-peak value (hereinafter, also referred to as "Vpp value") was verified based on the relationship between the peak-to-peak value and background smear. For evaluation of background smear, a state of toner attachment to a non-image portion was visually checked when an arbitrary image was output.

Evaluation conditions of the experimental example 1 are shown below.

Image forming apparatus: IMAGIO MP C5000

Developer: a cyan developer

Developing sleeve: an aluminium sleeve to which a tetrahedral amorphous carbon coating (hereinafter referred to as "ta-C coat") was applied Developing bias: a DC bias only, and an AC component-superimposed DC bias (with a frequency of 990 [Hz] and a plus-side duty ratio of 7 [%])

Criteria of the background smear evaluation ranks are shown below.

Rank "5": No background smear

Rank "4": No problem

Rank "3": Tolerable

Rank "2": Intolerable

Rank "1": Worse than "2"

Results of evaluation, based on the above evaluation criteria, of the experimental example 1 performed under varied developing bias conditions are shown in FIG. 16.

As the developing bias conditions, image formation was performed with both of a DC bias and an AC bias, and in the case of the AC bias, image formation was performed at a Vpp value of each of 1 [kV], 1.25 [kV], 1.5 [kV], and 1.75 [kV].

From the results of the experimental example 1 shown in FIG. 16, it is seen that with the DC bias, no problem occurred due to background smear, whereas with the AC bias, an intolerable background smear occurred when the Vpp value was 1.75 [kV]. Hence, it is desirable to set the Vpp value to 1.5 [kV] or smaller when applying an AC bias.

Experimental Example 2

In the experimental example 2, an upper limit value of the frequency of the developing bias was verified based on the relationship between the frequency of the developing bias and peripheral white void. "Peripheral white void" refers to a trouble that an absence of an image about the boundary between a high-density portion and a low-density portion appears white. For evaluation of peripheral white void, an image composed of solid portions and 50 [%]-density portions arranged in a checkered formation was visually checked.

Evaluation conditions of the experimental example 2 are shown below.

Image forming apparatus: IMAGIO MP C5000

Developer: a cyan developer

Developing sleeve: an aluminium sleeve with a ta-C coat

Developing bias: a DC bias only, and an AC component-superimposed DC bias (with a peak-to-peak value of 800 [V] and a plus-side duty ratio of 7 [%])

Criteria of the peripheral white void evaluation ranks are shown below.

Rank "5": No peripheral white void
Rank "4": No problem
Rank "3": Tolerable
Rank "2": Intolerable
Rank "1": Worse than "2"

Results of evaluation, based on the above evaluation criteria, of the experimental example 2 performed under varied developing bias conditions are shown in FIG. 17.

As the developing bias conditions, image formation was performed with both of a DC bias and an AC bias, and in the case of the AC bias, image formation was performed at a frequency of each of 0.99 [kHz], 2 [kHz], 5.5 [kHz], and 9 [kHz].

From the results of the experimental example 2 shown in FIG. 17, it is seen that with the DC bias, no peripheral white void was generated. Meanwhile, with the AC bias, the results were the rank "3" or higher in the range in which the experiments were performed. When the frequency was 5.5 [kHz], the result was the rank "3", whereas when the frequency was 2 [kHz], the result was the rank "4", which indicated an obvious improvement in suppressing peripheral white void. Hence, it is desirable to set the frequency to 2 [kHz] or lower when applying an AC bias.

Further, as shown in FIG. 17, when the frequency was 0.99 [kHz], there was no peripheral white void, and the rank of peripheral white void was higher than when the frequency was 2 [kHz]. Hence, the frequency for AC bias application was preferably 2 [kHz] or lower, and more preferably 1 [kHz] or lower to suppress generation of peripheral white void.

However, when the frequency is too low, image density unevenness due to the cycles of the AC bias would be visually observed. Specifically, image density variations depending on the conveying direction positions on a transfer sheet would be visually perceived as a stripe pattern.

The frequency was shifted under 990 [Hz], and as a result, no image density unevenness was visually observed at a frequency no lower than 800 [Hz]. At the frequency of 700 [Hz], a stripe pattern started to be seen. At the frequency of 600 [Hz], a stripe pattern was apparently observed. Hence, the frequency is preferably 800 [Hz] or higher.

Experimental Example 3

In the experimental example 3, an upper limit value of the plus-side duty ratio of the developing bias was verified based on the relationship between the plus-side duty ratio of the developing bias and granularity over an image. For evaluation of granularity, an image having an image occupation rate of 70 [%] was visually checked. "Granularity" is a value evaluating roughness to the touch over an image, and a smaller value means a better image quality.

Evaluation conditions of the experimental example 3 are shown below.

Image forming apparatus: IMAGIO MP C5000
Developer: a cyan developer
Developing sleeve: an aluminium sleeve with a ta-C coat
Developing bias: a DC bias only, and an AC component-superimposed DC bias (with a peak-to-peak value of 800 [V] and a frequency of 990 [Hz])

Criteria of the granularity evaluation ranks are shown below.

Rank "5": Granularity is good
Rank "4": No problem
Rank "3": Tolerable
Rank "2": Intolerable
Rank "1": Worse than "2"

Results of evaluation, based on the above evaluation criteria, of the experimental example 3 performed under varied developing bias conditions are shown in FIG. 18.

As the developing bias conditions, image formation was performed with both of a DC bias and an AC bias, and in the case of the AC bias, image formation was performed at a plus-side duty ratio of each of 4 [%], 7 [%], 20 [%], and 50 [%].

From the results of the experimental example 3 shown in FIG. 18, it is seen that with the DC bias, granularity was good. Meanwhile, with the AC bias, granularity was worse than the rank "2" indicating the "intolerable" level when the plus-side duty ratio was 50 [%], and the produced image was rough to the touch. When the plus-side duty ratio was 20 [%], granularity was evaluated as the rank "4" indicating the "no problem" level, which was better than the rank "3" indicating the "tolerable" level.

It is preferable to set the frequency of the AC bias to 2 [kHz] or lower to prevent peripheral white void, as seen from FIG. 17. However, when image formation was performed by application of an AC bias having a frequency of 990 [Hz], which was lower than 2 [kHz], granularity at a plus-side duty ratio of 50 [%] was worse than granularity by DC bias application, as seen from FIG. 18. In this regard, lowering the plus-side duty ratio (to 20 [%] or less) can reduce the toner drawing-back effect of moving the toner from an electrostatic latent image over the photoconductor 1 to the developing sleeve 51, leading to suppression of granularity degradation. Hence, it is desirable to set the plus-side duty ratio to 20 [%] or less when setting the frequency to 2 [kHz] or lower in the scheme of applying an AC bias.

Furthermore, a plus-side duty ratio of 4 [%] is more desirable than 20 [%] because the rank of granularity would be even higher.

EXAMPLES

Examples of the present invention will be described below. However, the present invention is not limited to these Examples by any means. "Part" and "%" represent "part by mass" and "% by mass", unless otherwise expressly specified.

<Core Particles>

Powders of $MnCO_3$, $Mg(OH)_2$, $Fe_2O_3$, and $SrCO_3$ were weighed out and mixed together, to thereby obtain a mixture powder.

The mixture powder was calcined with a heating furnace at 850° C. for 1 hour in an atmospheric air, and the obtained calcined product was cooled and pulverized to a powder having an average particle diameter of 3 μm.

A dispersant and water were added to the obtained powder to slurry the powder. The obtained slurry was fed to a spray dryer to be granulated, to thereby obtain a granular product having an average particle diameter of about 40 μm.

The granular product was loaded in a burning furnace, and burned under a nitrogen atmosphere at 1,180° C. for 4 hours. The obtained burned product was crushed with a crushing machine, and sieved for granularity adjustment, to thereby obtain spherical ferrite particles (core particles 1) having a volume average particle diameter of about 35 μm.

Componential analysis of the core particles 1 was performed, and the results were MnO: 40.0 mol %, MgO: 10.0 mol %, $Fe_2O_3$: 50 mol %, and SrO: 0.4 mol %. An arithmetic average surface roughness Ra2 of the core particles 1 was 0.63 μm.

<Fine Particles>

<<Production of Particles 1>>

Aluminium oxide (AKP-30 manufactured by Sumitomo Chemical Co., Ltd.) (100 g) was dispersed in water (1 L) to produce a suspension liquid, and this liquid was heated to 70° C. A solution obtained by dissolving stannic chloride (100 g) and phosphorus pentoxide (3 g) in a 2 N hydrochloric acid (1 L), and 12% by mass ammonia water were dropped into the suspension liquid in 2 hours such that the pH of the suspension liquid would be from 7 to 8. After the dropping, the suspension liquid was filtrated and washed, and the obtained cake was dried at 110° C. Then, the obtained dry powder was treated under a nitrogen stream at 500° C. for 1 hour, to thereby obtain particles 1, which were conductive fine particles.

The obtained particles 1 have a volume average particle diameter of 350 nm, and a powder resistivity of 1.3 (Log Ω·cm).

<<Production of Particles 2>>

For the particles 2, aluminium oxide (AKP-30 manufactured by manufactured by Sumitomo Chemical Co., Ltd.) that was subjected to a surface treatment, and had a volume average particle diameter of 30 nm, and a powder resistivity of 0.5 (Log Ω·cm) was used. The surface treatment layer was a two-layered structure composed of a lower layer made of tin dioxide and an upper layer made of tin dioxide-containing indium oxide.

<<Particles 3>>

Aluminium oxide (AKP-30 manufactured by Sumitomo Chemical Co., Ltd.) was used. The volume average particle diameter thereof was 300 nm, and the powder resistivity thereof was 4.8 (Log Ω·cm).

<<Particles 4>>

For the particles 4, BLACK PEARLS-2000 (manufactured by Cabot Corporation, with a specific surface area of 1,500 $mm^2/g$, and an aspect ratio of 3) was used. The volume average particle diameter thereof was 12 nm, and the powder resistivity thereof was −1.5 (Log Ω·cm).

<Resin>

<<Resin 1>>

A silicone resin solution SR2410 (manufactured by Dow Corning Toray Silicone Co., Ltd.) was used.

<<Resin 2>>

Toluene (300 g) was poured in a flask equipped with a stirrer, and heated to 90° C. under a nitrogen gas stream. Into which, a mixture of 3-methacryloxy propyl tris(trimethyl siloxy)silane represented by a structural formula: $CH_2{=}CMe{-}COO{-}C_3H_6{-}Si(OSiMe_3)_3$ (where Me represents a methyl group) (200 mmol, SILAPLANE TM-0701T manufactured by Chisso Corporation) (84.4 g), 3-methacryloxy propyl methyl diethoxy silane (39 g) (150 mmol), methyl methacrylate (65.0 g) (650 mmol), and 2,2'-azobis-2-methyl butyronitrile (0.58 g) (3 mmol) was dropped in 1 hour. After the dropping was completed, a solution obtained by dissolving 2,2'-azobis-2-methyl butyronitrile (0.06 g) (0.3 mmol) in toluene (15 g) was further added thereto (resulting in a total 2,2'-azobis-2-methyl butyronitrile amount of 0.64 g, 3.3 mmol), and they were mixed at a temperature of from 90° C. to 100° C. for 3 hours to induce radical copolymerization, to thereby obtain a methacrylic-based copolymer (resin 2).

The weight average molecular weight of the obtained resin 2 was 33,000. Then, the resin 2 was diluted with toluene such that the solid content of the resin 2 would be 23% by mass. The resin 2 solution obtained in this way had a viscosity of 8.8 $mm^2/s$, and a specific gravity of 0.91.

Example 1

A carrier used in Example 1 was produced in the manner described below.

<Production of Carrier 1>

To form a coating layer of a carrier 1 for electrostatic latent image development, a coating layer forming solution A (with a solid content of 10% by mass) having the composition described below was prepared.

—Composition of Coating Layer Forming Solution A—

Coating layer resin (resin 1) (with a solid content of 43%)—10 parts by mass Coating layer resin (resin 2) (with a solid content of 23%)—1 part by mass Conductive fine particles 1—18.1 parts by mass Catalyst—1 part by mass (titanium diisopropoxy bis(ethyl acetoacetate)) (ORGATIX TC-750 manufactured by Matsumoto Fine Chemical Co., Ltd.)

Silane coupling agent—0.6 parts by mass (SH6020 manufactured by Dow Corning Toray Co., Ltd.)

Toluene—197.3 parts by mass

The manner for dispersing the coating layer forming solution was not particularly limited. In Example 1, the dispersion was performed with a TK homomixer at 13,000 rpm for 10 minutes.

The coating layer forming solution A was applied over the core particles 1 (1,000 parts by mass), and dried. The application and the drying were performed with a fluid bed coater with an internal temperature of each fluid tank controlled to 70° C. The obtained carrier was burned in an electric furnace at 180° C. for 2 hours, to thereby obtain a carrier 1.

The properties of the carrier 1 are shown in Table 1-1 below. The dispersed particle diameter of the fine particles in the coating layer shown in Table 1-1 was obtained by observing a cross-section of the carrier with a transmission electron microscope (TEM), measuring the diameter of an arbitrary hundred particles, and averaging the measurements.

<Production of Developer 1>

A toner (70 parts by mass) for a commercially available digital full-color printer (RICOH PRO C901 manufactured by Ricoh Company, Ltd.) was mixed with the carrier 1 (930 parts by mass) obtained above, and they were stirred with a Turbula mixer at 81 rpm for 5 minutes, to thereby produce a developer for evaluation. Furthermore, a developer for replenishment was produced in a manner that the toner concentration would be 10% by mass, using the carrier and the toner described above.

<Image Evaluation>

A commercially available digital full-color copier (IMAGIO MP C500 manufactured by Ricoh Company, Ltd.) was remodeled and mounted with a developing device having the conditions shown in Tables 2-1 and 2-2 below, and loaded with the developer 1 obtained above, to perform image formation for image evaluation. As the conditions of the developing device, presence or absence of coating of the low friction film 51 over the developing sleeve 51, and the set of voltages to be applied were varied from these conditions in the developing device shown in FIG. 11, as shown in Tables 2-1 and 2-2 below.

With the image forming apparatus obtained above, various evaluation experiments described below were performed. The results are shown in Tables 3-1 and 3-2.

<<Density Unevenness Evaluation Method>>

An image having a dot percent of 75 [%] (in a cyan color only) was printed over a sheet having an A3 size, and luminosity deviation (maximum luminosity—minimum luminosity) in the image was measured. X-RITE 939 (manufactured by X-Rite, Inc.) was used for measurement of the luminosity.

<Criteria of Density Unevenness Evaluation>

A: The luminosity deviation in the image was less than 1.0.

B: The luminosity deviation in the image was 1.0 or greater but less than 1.5.

C: The luminosity deviation in the image was 1.5 or greater but less than 2.0.

D: The luminosity deviation in the image was 2.0 or greater (with a density unevenness).

<<Evaluation of Influence (Ghost Image) of Hysteresis>>

A character chart having an image occupation rate of 8% (with a character size of about 2 mm×2 mm per character) was output over 100,000 sheets. After this, a vertical band chart shown in FIG. 20 was printed, and a density difference between a portion (a) printed during one rotation of the sleeve and a portion (b) printed after one rotation of the sleeve was measured, to thereby evaluate any influence of the history of an immediately previous image. A color value measuring instrument (X-RITE 938 manufactured by X-Rite, Inc.) was used for the measurement. The density difference was measured at three positions, namely the center, rear, and front of the sleeve, and their average density difference ΔID was obtained. The evaluation criteria are as follows.

<Evaluation Criteria>

A: ΔID was 0.01 or less.

B: ΔID was 0.03 or less but greater than 0.01.

C: ΔID was 0.06 or less but greater than 0.03.

D: ΔID was greater than 0.06.

Here, A indicates a "very good" level, B indicates a "good" level, C indicates a "tolerable" level, and D indicates a "practically unusable" level. A, B, and C are passable levels, and D is a rejectable level.

<<Evaluation of Initial Carrier Adhesion>>

A solid image was developed with the background potential fixed to 150 V.

At the time, a developing potential Vpot. required for the solid image density to reach 1.0 was measured.

Further, the number of carrier particles adhered over the surface of the photoconductor when the developing potential Vpot. was supplied was counted by observation with a magnifying glass from five fields of view, and evaluated as an amount of solid image carrier adhesion. The number of adhered carrier particles per 100 $cm^2$ was averaged for the five fields of view, and the average number was used as the amount of solid image carrier adhesion.

<Evaluation Criteria>

A: 20 particles or less

B: From 21 particles to 60 particles

C: From 61 particles to 80 particles

D: 81 particles or more

A, B, and C are passable levels, and D is a rejectable level.

<<Evaluation of Edge Effect>>

A test pattern having an image with a large area was output. The difference between the image density in the center portion and the image density in an edge portion in the obtained image pattern was evaluated based on the evaluation criteria below by visual check.

<Evaluation Criteria>

A: No difference

B: There was a slight difference.

C: There was a difference, but it was tolerable.

D: There was a difference to an intolerable level.

A, B, and C are passable levels, and D is a rejectable level.

<<Evaluation of Image Definition>>

A character chart having an image occupation rate of 5% (with a character size of about 2 mm×2 mm per character) was output. The image definition was evaluated based on the reproducibility at the character image portion, and ranked as follows.

<Evaluation Criteria>

A: Very good

B: Good

C: A tolerable level

D: A practically unusable level

A, B and C are passable levels, and D is a rejectable level.

<<Evaluation of Background Smear>>

After an output durability test of outputting a chart with an image occupation rate of 5% continuously over 100,000 sheets, the condition of toner contamination in the copier was visually checked and evaluated based on the criteria below.

<Evaluation Criteria>

A: No toner contamination was observed at all, with a very good condition.

B: Almost no toner contamination was observed, with a good condition.

C: Contamination was observed, but was practically non-problematic.

D: There was a severe contamination that was beyond the tolerable level, and problematic.

A, B, and C are passable levels, and D is a rejectable level.

<<Evaluation of Color Overlapping>>

A full-color test pattern was output. The condition of color overlapping in the obtained image pattern was visually checked and evaluated based on the evaluation criteria below.

<Evaluation Criteria>

A: Totally non-problematic level.

B: There was a slight color overlapping, but it was a practically tolerable level.

C: A practically intolerable level.

<<Evaluation of Durability>>

A running evaluation was performed over 100,000 sheets in a single color. The volume resistivity (Log Ω·cm) of the carrier after the running was completed was measured, and at the same time, carrier adhesion, an amount of reduction in the static buildup, and an amount of reduction in the resistance were evaluated. The carrier adhesion was evaluated in the same manner as the evaluation of initial carrier adhesion described above.

<<<Evaluation of Amount of Reduction in Static Buildup>>>

The amount of reduction in the static buildup was obtained as a difference between an amount of static buildup (Q1) before running measured by performing a blow-off test of a frictionally charged sample containing a mixture of a carrier (93% by mass) and a toner (7% by mass) with a common blow-off device (TB-200 manufactured by Toshiba Chemical Corporation), and an amount of static buildup (Q2) after running measured by the same method as above by removing the toner in the developer with the blow-off device (see FIG. 21) to obtain the carrier.

A practically non-problematic level of the amount of reduction in the static buildup is 10.0 μc/g or less on an absolute value basis. The causes of the reduction in the amount of static buildup are toner spent on the surface of the carrier, and wear of the coating film over the carrier. Therefore, toner spent, and durability of the carrier coating film can be evaluated based on the amount of reduction in static buildup.

<<<Evaluation of Amount of Reduction in Resistance>>>

The amount of reduction in the resistance was obtained as a difference between a common logarithmic value X1 (=$Log_{10}$R1) of a volume resistivity R1 of the carrier before running measured with a high resistance meter thirty seconds after application of a 1,000 V direct-current voltage to the carrier loaded between resistance-measuring parallel electrodes (with a gap of 2 mm), and a common logarithmic value X2 (=$Log_{10}$ R2) of a volume resistivity R2 of the carrier after the running measured by the same method as the above volume resistivity measuring method after removing the toner in the developer with the blow-off device (see FIG. 21).

A practically non-problematic level of the amount of reduction in the resistance is 3.0 (Log Ω·cm) or less on an absolute value basis.

The causes of the resistance change are scraping-off of the binder resin film of the carrier, spent of the toner component, detachment of fine particles having a large particle diameter in the carrier coating film, etc. Therefore, generation of these problems can be evaluated based on the amount of change in the resistance.

Examples 2 to 27

Carriers 2 to 27 used in Examples 2 to 27 were produced in the same manner as in Example 1, except that the kind of the fine particles, the method for dispersing the fine particles, and the carrier production conditions were changed from Example 1 as shown in Tables 1-1 and 1-2.

As shown in Table 1-2, the coating layer forming solution for the carrier 21 was dispersed by media dispersion for 1 hour. Here, media dispersion refers to dispersion with a bead mill using Zr beads having a diameter of from about 0.1 mm to 0.3 mm, which is a dispersion method for obtaining a desired particle diameter under a condition under which aggregations due to an excessive dispersion energy would not be produced. The disperser is not particularly limited, but ULTRA APEX MILL manufactured by Kotobuki Industries, Co., Ltd. was used in the Example.

The volume resistivity values of the carriers 2 to 27 are as shown in Tables 1-1 and 1-2.

Developers 2 to 27 containing the carriers 2 to 27 were produced in the same manner as in Example 1.

Image evaluation of developing devices of Examples 2 to 27 was performed with the developers 2 to 27, and with the same developing device as used in Example 1 except that the presence or absence of and the kind of the low friction film coating over the developing sleeve, and the conditions of the voltages to be applied were changed from Example 1 as shown in Tables 2-1 and 2-2. The results are shown in Tables 3-1 and 3-2.

Comparative Examples 1 to 7

Comparative carriers 1 to 7 used in Comparative Examples 1 to 7 were produced in the same manner as in Example 1, except that the kind of the fine particles, the method for dispersing the fine particles, and the carrier production conditions were changed from Example 1 as shown in Table 1-2.

As shown in Table 1-2, media dispersion was performed for the comparative carriers 6 and 7, like the carrier 21 used in Example 21.

The volume resistivity values of the comparative carriers 1 to 7 are as shown in Table 1-2.

Comparative developers 1 to 7 containing the comparative carriers 1 to 7 were produced in the same manner as in Example 1.

Image evaluation of developing devices of Comparative Examples 1 to 7 was performed with the comparative developers 1 to 7, and with the same developing device as used in Example 1 except that the presence or absence of and the kind of the low friction film coating over the developing sleeve, and the conditions of the voltages to be applied were changed from Example 1 as shown in Tables 2-1 and 2-2. The results are shown in Tables 3-1 and 3-2.

TABLE 1-1

| | Carrier | | | | | | |
|---|---|---|---|---|---|---|---|
| | | Fine particles | | | | | |
| | Volume resistivity (LogΩ · cm) | Kind | Powder resistivity (LogΩ · cm) | Average particle dia. (nm) | Dispersion condition | Dispersion particle dia. (nm) | Content (% by mass) |
| Ex. 1 | 11.5 | Particles 1 | 1.3 | 350 | Homomixer 10 min | 400 | 80 |
| Ex. 2 | 11.5 | Particles 1 | 1.3 | 350 | Homomixer 10 min | 400 | 80 |
| Ex. 3 | 11.5 | Particles 1 | 1.3 | 350 | Homomixer 10 min | 400 | 80 |
| Ex. 4 | 11.5 | Particles 1 | 1.3 | 350 | Homomixer 10 min | 400 | 80 |
| Ex. 5 | 11.5 | Particles 1 | 1.3 | 350 | Homomixer 10 min | 400 | 80 |
| Ex. 6 | 11.5 | Particles 1 | 1.3 | 350 | Homomixer 10 min | 400 | 80 |
| Ex. 7 | 11.5 | Particles 1 | 1.3 | 350 | Homomixer 10 min | 400 | 80 |
| Ex. 8 | 11.5 | Particles 1 | 1.3 | 350 | Homomixer 10 min | 400 | 80 |
| Ex. 9 | 11.5 | Particles 1 | 1.3 | 350 | Homomixer 10 min | 400 | 80 |

TABLE 1-1-continued

| | Carrier | | | | | | |
|---|---|---|---|---|---|---|---|
| | | Fine particles | | | | | |
| | Volume resistivity (LogΩ · cm) | Kind | Powder resistivity (LogΩ · cm) | Average particle dia. (nm) | Dispersion condition | Dispersion particle dia. (nm) | Content (% by mass) |
| Ex. 10 | 11.5 | Particles 1 | 1.3 | 350 | Homomixer 10 min | 400 | 80 |
| Ex. 11 | 11.5 | Particles 1 | 1.3 | 350 | Homomixer 10 min | 400 | 80 |
| Ex. 12 | 11.5 | Particles 1 | 1.3 | 350 | Homomixer 10 min | 400 | 80 |
| Ex. 13 | 13 | Particles 1 | 1.3 | 350 | Homomixer 10 min | 400 | 50 |
| Ex. 14 | 13 | Particles 1 | 1.3 | 350 | Homomixer 10 min | 400 | 50 |
| Ex. 15 | 16 | Particles 3 | 4.8 | 300 | Homomixer 10 min | 350 | 50 |
| Ex. 16 | 11.5 | Particles 2 | 0.5 | 300 | Homomixer 10 min | 350 | 40 |
| Ex. 17 | 11.5 | Particles 4 | −1.5 | 12 | Homomixer 10 min | 400 | 10 |

TABLE 1-2

| | Carrier | | | | | | |
|---|---|---|---|---|---|---|---|
| | | Fine particles | | | | | |
| | Volume resistivity (LogΩ · cm) | Kind | Powder resistivity (LogΩ · cm) | Average particle dia. (nm) | Dispersion condition | Dispersion particle dia. (nm) | Content (% by mass) |
| Ex. 18 | 12 | Particles 4 | −1.5 | 12 | Homomixer 30 min | 200 | 10 |
| Ex. 19 | 12.5 | Particles 4 | −1.5 | 12 | Homomixer 60 min | 100 | 10 |
| Ex. 20 | 11.5 | Particles 4 | −1.5 | 12 | Homomixer 60 min | 100 | 20 |
| Ex. 21 | 12 | Particles 4 | −1.5 | 12 | Media dispersion 1 hr | 30 | 20 |
| Ex. 22 | 13 | Particles 1 | 1.3 | 350 | Homomixer 10 min | 400 | 50 |
| Ex. 23 | 12.5 | Particles 1 | 1.3 | 350 | Homomixer 10 min | 400 | 62 |
| Ex. 24 | 13.5 | Particles 1 | 1.3 | 350 | Homomixer 10 min | 400 | 40 |
| Ex. 25 | 14 | Particles 1 | 1.3 | 350 | Homomixer 10 min | 400 | 30 |
| Ex. 26 | 15 | Particles 1 | 1.3 | 350 | Homomixer 10 min | 400 | 10 |
| Ex. 27 | 16 | Particles 1 | 1.3 | 350 | Homomixer 10 min | 400 | 8 |
| Comp. Ex. 1 | 11.5 | Particles 1 | 1.3 | 350 | Homomixer 10 min | 400 | 80 |
| Comp. Ex. 2 | 9 | Particles 1 | 1.3 | 350 | Homomixer 10 min | 400 | 100 |
| Comp. Ex. 3 | 11 | Particles 1 | 1.3 | 350 | Homomixer 10 min | 400 | 90 |
| Comp. Ex. 4 | 7 | Particles 4 | −1.5 | 12 | Homomixer 10 min | 400 | 30 |
| Comp. Ex. 5 | 10 | Particles 4 | −1.5 | 12 | Homomixer 60 min | 100 | 30 |
| Comp. Ex. 6 | 9 | Particles 4 | −1.5 | 12 | Media dispersion 1 hr | 30 | 35 |
| Comp. Ex. 7 | 9.5 | Particles 4 | −1.5 | 12 | Media dispersion 2 hr | 15 | 35 |

TABLE 2-1

| | Device | | | | | |
|---|---|---|---|---|---|---|
| | Bias scheme | \| Vpp1 − Vpp2 \| | Vpp1 | Vpp2 | VL | Voff (DC) |
| Ex. 1 | AC | 1,500 | −900 | 600 | −100 | −150 |
| Ex. 2 | AC | 850 | −700 | 150 | −100 | −275 |
| Ex. 3 | AC | 600 | −800 | −200 | −100 | −500 |
| Ex. 4 | AC | 700 | −850 | −150 | −100 | −500 |
| Ex. 5 | AC | 1,300 | −1,150 | 150 | −100 | −500 |
| Ex. 6 | AC | 1,550 | −1,150 | 400 | −100 | −375 |
| Ex. 7 | AC | 100 | −450 | −350 | −100 | −400 |
| Ex. 8 | AC | 600 | −920 | −320 | −60 | −500 |
| Ex. 9 | AC | 600 | −680 | −80 | −60 | −500 |
| Ex. 10 | AC | 600 | −632 | −32 | −30 | −500 |
| Ex. 11 | AC | 600 | −608 | −8 | 5 | −500 |
| Ex. 12 | AC | 600 | −530 | 70 | −60 | −500 |
| Ex. 13 | AC | 600 | −530 | 70 | −60 | −500 |
| Ex. 14 | AC | 600 | −530 | 70 | −60 | −500 |
| Ex. 15 | AC | 600 | −530 | 70 | −60 | −506 |
| Ex. 16 | AC | 600 | −530 | 70 | −60 | −500 |
| Ex. 17 | AC | 600 | −530 | 70 | −60 | −500 |
| Ex. 18 | AC | 600 | −530 | 70 | −60 | −500 |
| Ex. 19 | AC | 600 | −530 | 70 | −60 | −500 |
| Ex. 20 | AC | 600 | −530 | 70 | −60 | −500 |
| Ex. 21 | AC | 600 | −530 | 70 | −60 | −500 |
| Ex. 22 | AC | 600 | −530 | 70 | −60 | −500 |
| Ex. 23 | AC | 600 | −530 | 70 | −60 | −500 |
| Ex. 24 | AC | 600 | −530 | 70 | −60 | −500 |
| Ex. 25 | AC | 600 | −530 | 70 | −60 | −500 |
| Ex. 26 | AC | 600 | −530 | 70 | −60 | −500 |
| Ex. 27 | AC | 600 | −530 | 70 | −60 | −500 |
| Comp. Ex. 1 | DC | None | None | None | −100 | −500 |
| Comp. Ex. 2 | AC | 600 | −530 | 70 | −60 | −500 |
| Comp. Ex. 3 | AC | 600 | −530 | 70 | −60 | −500 |
| Comp. Ex. 4 | AC | 600 | −530 | 70 | −60 | −500 |
| Comp. Ex. 5 | AC | 600 | −530 | 70 | −60 | −500 |
| Comp. Ex. 6 | AC | 600 | −530 | 70 | −60 | −500 |
| Comp. Ex. 7 | AC | 600 | −530 | 70 | −60 | −500 |

TABLE 2-2

| | Device | | | |
|---|---|---|---|---|
| | Plus-side duty ratio (%) | Frequency F (kHz) | Sleeve element tube | Sleeve surface material |
| Ex. 1 | 50 | 1.8 | Al | None |
| Ex. 2 | 50 | 1.8 | Al | None |
| Ex. 3 | 50 | 1.8 | Al | None |
| Ex. 4 | 50 | 1.8 | Al | None |
| Ex. 5 | 50 | 1.8 | Al | None |
| Ex. 6 | 50 | 1.8 | Al | None |
| Ex. 7 | 50 | 1.8 | Al | None |
| Ex. 8 | 70 | 1.8 | Al | None |
| Ex. 9 | 30 | 1.8 | Al | None |
| Ex. 10 | 22 | 1.8 | Al | None |
| Ex. 11 | 18 | 1.8 | Al | None |
| Ex. 12 | 5 | 1.8 | Al | None |
| Ex. 13 | 5 | 1.8 | Al | None |
| Ex. 14 | 5 | 1.8 | Al | TAC |
| Ex. 15 | 4 | 1.8 | Al | TAC |
| Ex. 16 | 5 | 1.8 | Al | TAC |
| Ex. 17 | 5 | 1.8 | Al | TAC |
| Ex. 18 | 5 | 1.8 | Al | TAC |
| Ex. 19 | 5 | 1.8 | Al | TAC |
| Ex. 20 | 5 | 1.8 | Al | TAC |
| Ex. 21 | 5 | 1.8 | Al | TAC |
| Ex. 22 | 5 | 1.8 | Al | $TiO_2$ |
| Ex. 23 | 5 | 1.8 | Al | TAC |
| Ex. 24 | 5 | 1.8 | Al | TAC |
| Ex. 25 | 5 | 1.8 | Al | TAC |
| Ex. 26 | 5 | 1.8 | Al | TAC |
| Ex. 27 | 5 | 1.8 | Al | TAC |
| Comp. Ex. 1 | None | — | Al | None |
| Comp. Ex. 2 | 5 | 1.8 | Al | TAC |
| Comp. Ex. 3 | 5 | 1.8 | Al | TAC |
| Comp. Ex. 4 | 5 | 1.8 | Al | TAC |
| Comp. Ex. 5 | 5 | 1.8 | Al | TAC |
| Comp. Ex. 6 | 5 | 1.8 | Al | TAC |
| Comp. Ex. 7 | 5 | 1.8 | Al | TAC |

TABLE 3-1

| | | | | Initial carrier adhesion | | | |
|---|---|---|---|---|---|---|---|
| | Density | Ghost image | | Required developed potential | Solid image carrier | Edge | Image |
| | unevenness | Evaluation | ΔID | (V pot.) | adhesion | effect | definition |
| Ex. 1 | C | C | 0.06 | 800 | C | B | B |
| Ex. 2 | C | C | 0.05 | 600 | B | B | B |
| Ex. 3 | C | C | 0.03 | 350 | A | B | B |
| Ex. 4 | C | C | 0.03 | 400 | A | B | B |
| Ex. 5 | C | C | 0.04 | 600 | B | B | B |
| Ex. 6 | C | C | 0.06 | 700 | C | C | C |
| Ex. 7 | C | C | 0.05 | 400 | B | B | B |
| Ex. 8 | C | C | 0.06 | 650 | C | C | C |
| Ex. 9 | C | C | 0.04 | 380 | B | B | B |
| Ex. 10 | C | B | 0.03 | 400 | B | B | B |
| Ex. 11 | B | B | 0.02 | 450 | B | B | B |
| Ex. 12 | A | B | 0.02 | 500 | C | B | B |
| Ex. 13 | A | B | 0.02 | 300 | A | B | B |
| Ex. 14 | A | A | 0 | 300 | A | B | B |
| Ex. 15 | C | C | 0.05 | 350 | A | C | C |
| Ex. 16 | A | A | 0 | 400 | B | B | B |
| Ex. 17 | A | A | 0 | 500 | C | B | B |
| Ex. 18 | A | A | 0.01 | 400 | B | B | B |
| Ex. 19 | A | B | 0.03 | 350 | A | B | B |
| Ex. 20 | A | A | 0.01 | 500 | C | B | B |

TABLE 3-1-continued

| | Density | Ghost image | | Initial carrier adhesion | | Edge | Image |
|---|---|---|---|---|---|---|---|
| | | | | Required developed potential | Solid image carrier | | |
| | unevenness | Evaluation | ΔID | (V pot.) | adhesion | effect | definition |
| Ex. 21 | A | C | 0.04 | 400 | B | C | C |
| Ex. 22 | B | A | 0.01 | 300 | A | B | B |
| Ex. 23 | A | A | 0.01 | 280 | B | B | B |
| Ex. 24 | B | B | 0.03 | 260 | B | B | B |
| Ex. 25 | B | C | 0.04 | 280 | B | B | B |
| Ex. 26 | C | C | 0.05 | 300 | A | C | C |
| Ex. 27 | C | C | 0.06 | 350 | A | C | C |
| Comp. Ex. 1 | D | D | 0.1 | 400 | B | B | B |
| Comp. Ex. 2 | A | A | 0 | 900 | D | B | B |
| Comp. Ex. 3 | A | A | 0 | 800 | D | B | B |
| Comp. Ex. 4 | A | A | 0 | 650 | D | B | B |
| Comp. Ex. 5 | A | B | 0.02 | 750 | D | B | B |
| Comp. Ex. 6 | C | C | 0.03 | 850 | D | B | B |
| Comp. Ex. 7 | C | D | 0.09 | 900 | D | B | B |

TABLE 3-2

| | Bg. smear | Color overlapping | Durability | | | |
|---|---|---|---|---|---|---|
| | | | Volume resistivity after running (LogΩ · cm) | Carrier adhesion after running | Reduction in static buildup (μc/g) | Reduction in resistance (LogΩ · cm) |
| Ex. 1 | B | A | 10.5 | B | 5.0 | 1.0 |
| Ex. 2 | B | A | 10.5 | B | 5.0 | 1.0 |
| Ex. 3 | B | A | 10.5 | B | 5.0 | 1.0 |
| Ex. 4 | B | A | 10.5 | B | 5.0 | 1.0 |
| Ex. 5 | B | A | 10.5 | C | 5.0 | 1.0 |
| Ex. 6 | B | A | 10.5 | C | 5.0 | 1.0 |
| Ex. 7 | B | A | 10.5 | B | 5.0 | 1.0 |
| Ex. 8 | B | A | 10.5 | B | 5.0 | 1.0 |
| Ex. 9 | B | A | 10.5 | B | 5.0 | 1.0 |
| Ex. 10 | B | A | 10.5 | B | 5.0 | 1.0 |
| Ex. 11 | C | A | 10.5 | B | 5.0 | 1.0 |
| Ex. 12 | B | A | 10.5 | B | 5.0 | 1.0 |
| Ex. 13 | B | A | 10.5 | B | 5.0 | 2.5 |
| Ex. 14 | A | A | 10.5 | B | 5.0 | 2.5 |
| Ex. 15 | B | A | 16 | B | 5.0 | 0.0 |
| Ex. 16 | B | A | 10 | B | 2.0 | 1.5 |
| Ex. 17 | B | B | 9 | C | 3.0 | 2.5 |
| Ex. 18 | B | B | 9 | C | 5.0 | 3.0 |
| Ex. 19 | B | B | 9 | C | 8.0 | 3.5 |
| Ex. 20 | B | B | 10 | C | 5.0 | 1.5 |
| Ex. 21 | B | B | 9 | C | 2.0 | 3.0 |
| Ex. 22 | B | A | 10.5 | B | 5.0 | 2.5 |
| Ex. 23 | C | A | 10.5 | B | 6.0 | 2.0 |
| Ex. 24 | B | A | 11 | B | 2.0 | 2.5 |
| Ex. 25 | B | A | 13 | B | 6.0 | 1.0 |
| Ex. 26 | B | A | 12 | B | 9.0 | 3.0 |
| Ex. 27 | B | A | 7.5 | C | 10.0 | 8.5 |
| Comp. Ex. 1 | B | A | 10.5 | B | 5.0 | 2.5 |
| Comp. Ex. 2 | B | A | 11.5 | B | 15.0 | −2.5 |
| Comp. Ex. 3 | B | A | 12 | B | 15.0 | −1.0 |
| Comp. Ex. 4 | B | C | 7 | D | 9.0 | 0.0 |
| Comp. Ex. 5 | B | C | 10 | C | 8.0 | 0.0 |

TABLE 3-2-continued

| | Bg. smear | Color overlapping | Durability: Volume resistivity after running (LogΩ · cm) | Durability: Carrier adhesion after running | Durability: Reduction in static buildup (μc/g) | Durability: Reduction in resistance (LogΩ · cm) |
|---|---|---|---|---|---|---|
| Comp. Ex. 6 | D | B | 7.5 | D | 4.0 | 1.5 |
| Comp. Ex. 7 | D | B | 6.5 | D | 6.0 | 3.0 |

As indicated by the results of Examples 1 to 25, it was revealed that the developing device of the present invention could remedy cyclic density variations, reduce influences of a plus-side bias arising from use of an AC developing bias, and suppress degradation of the developing ability for a long term. Particularly, it was revealed that the developing device using an RP developing bias as the AC developing bias showed favorable and well-balanced results in all of the evaluation items.

Aspects of the present invention are as follows, for example.

<1> A developing device, including: a developer containing a toner and a carrier; and a developer bearer configured to have a surface thereof bear the developer thereon and endlessly move, and to develop a latent image over a surface of a latent image bearer by supplying the toner in the developer to the latent image in a developing region where the developer bearer faces the latent image bearer, wherein the carrier contains fine particles, and a value X in a volume resistivity R ($=10^X$) (Ω·cm) of the carrier is from 11.5 to 16.0, wherein the developer bearer includes: a magnetic field generating unit including a plurality of magnetic poles; and a developing sleeve having a cylindrical shape enclosing the magnetic field generating unit, and configured to bear the developer over an outer circumferential surface of the cylindrical shape by means of a magnetic force of the magnetic field generating unit and to perform surface moving by rotating relative to a body of the developing device, and wherein the developing device includes a developing sleeve voltage applying unit configured to apply a voltage containing an alternating-current component to the developing sleeve.

<2> The developing device according to <2>, wherein in the developing sleeve voltage applying unit, a bias in which an alternating-current (AC) component is superimposed on a direct-current (DC) component has a peak-to-peak relationship represented by a formula below, between a maximum value thereof (referred to as Vpp1) and minimum value thereof (referred to as Vpp2) on a regular toner charge polarity side, $$|Vpp1-Vpp2|\leq 1{,}500\ \text{V}.$$

<3> The developing device according to <1> or <2>, wherein in the developing sleeve voltage applying unit, a bias in which an alternating-current (AC) component is superimposed on a direct-current (DC) component has a peak-to-peak relationship represented by a formula below, among a maximum value thereof (referred to as Vpp1) and minimum value thereof (referred to as Vpp2) on a regular toner charge polarity side, and a potential (VL) of an image portion of a latent image over the latent image bearer, $$|Vpp1|>|Vpp2|>|VL|.$$

<4> The developing device according to any one of <1> to <3>, wherein in the developing sleeve voltage applying unit, a plus-polarity component of an alternating-current component of an AC developing bias has a duty ratio of 20% or less.

<5> The developing device according to any one of <1> to <4>, wherein in the developing sleeve voltage applying unit, an AC developing bias has a frequency f of 2 (kHz) or lower.

<6> The developing device according to any one of <1> to <5>, wherein the carrier includes a coating layer containing the fine particles and a resin, and a content of the fine particles relative to a total amount of the resin and the fine particles in the coating layer is from 10% by mass to 85% by mass.

<7> The developing device according to any one of <1> to <6>, wherein the fine particles have a powder resistivity of from −3 (Log Ω·cm) to 3 (Log Ω·cm).

<8> The developing device according to any one of <1> to <7>, wherein the fine particles are fine particles containing one or more of alumina, silica, titanium, barium, tin, and carbon.

<9> The developing device according to any one of <1> to <8>, wherein the carrier includes a coating layer containing the fine particles and a resin, and a dispersed particle diameter of the fine particles in the coating layer is from 50 nm to 600 nm.

<10> The developing device according to any one of <1> to <9>, including:

a low friction surface layer over the outer circumferential surface of the developing sleeve, wherein a coefficient of friction of the low friction surface layer with respect to the toner is smaller than that of a material of a sleeve element tube forming the cylindrical shape with respect to the toner.

<11> The developing device according to <10>, wherein the material of the sleeve element tube is aluminium.

<12> The developing device according to <10> or <11>, wherein the low friction surface layer is made of tetrahedral amorphous carbon.

<13> An image forming apparatus, including:

a latent image bearer;

a latent image forming unit configured to form a latent image over the latent image bearer;

a developing unit configured to form a toner image by developing the latent image formed over the latent image bearer with a developer;

a transfer unit configured to transfer the toner image formed over the latent image bearer to a recording medium; and a fixing unit configured to fix the toner image transferred to the recording medium thereon, wherein the developing device according to any one of <1> to <12> is used as the developing unit.

REFERENCE SIGNS LIST

1 electrostatic latent image bearer (photoconductor)
1Y yellow photoconductor
1C cyan photoconductor
1K black photoconductor
1M magenta photoconductor
2*a* cleaning blade
2 photoconductor cleaning device
3 script conveying unit
4 script reading unit
4*a* charging roller
5C cyan developing device
5K black developing device
5 developing device
6 image forming unit
7 paper feeding unit
8 intermediate transfer belt
9 first transfer bias roller
10 intermediate transfer unit
11 toner container
12 second transfer backup roller
19 second transfer bias roller
20 fixing device
25 pair of paper ejection rollers
26 paper feeding cassette
27 paper feeding roller
28 pair of registration rollers
30 paper ejection tray
40 charging device
41 lubricant applying device
50 developing roller
51 developing sleeve
51*a* sleeve element tube
51*b* low friction film
52 doctor blade
53 supplying screw
53*a* supplying/conveying path
54 collecting screw
54*a* collecting/conveying path
55 magnet roller
57 divider member
58 casing
58*a* development lower case
58*b* development upper case
58*c* development cover
58*e* development opening
59 toner supply port
71 agent fall-down port
72 agent uplifting port
100 printer unit
110 fine particles
111 coating layer
112 core particles
151 developing sleeve power supply
500 copier
G developer G
P developing gap
L laser light
P transfer sheet
P1 first magnetic pole
P2 second magnetic pole
P3 third magnetic pole
P4 fourth magnetic pole
P5 fifth magnetic pole
T toner
Vb developing bias
Vbav developing bias average value
Vd charged potential
VL exposed potential
Vpot developing potential
Vpp peak-to-peak value
α collecting screw downstream end region
β supplying screw downstream end region

The invention claimed is:

1. A developing device, comprising:

a two-component-type developer comprising a toner and a carrier; and a developer bearer configured to have a surface thereof bear the developer thereon and endlessly move, and to develop a latent image over a surface of a latent image bearer by supplying the toner in the developer to the latent image in a developing region where the developer bearer faces the latent image bearer, wherein:

the carrier comprises fine particles and core particles having a magnetic property, and a value X in a volume resistivity R ($=10^X$) (Ω·cm) of the carrier is from 11.5 to 16.0;

the developer bearer comprises:

a magnetic field generating unit that comprises a plurality of magnetic poles; and a developing sleeve having a cylindrical shape enclosing the magnetic field generating unit, and configured to bear the developer over an outer circumferential surface of the cylindrical shape by means of a magnetic force of the magnetic field generating unit and to perform surface moving by rotating relative to a body of the developing device; and the developing device comprises a developing sleeve voltage applying unit configured to apply a voltage that comprises an alternating-current component to the developing sleeve wherein in the developing sleeve voltage applying unit, a plus-polarity component of an alternating-current component of an AC developing bias has a duty ratio of 20% or less, wherein in the developing sleeve voltage applying unit, a bias in which an alternating-current (AC) component is superimposed on a direct-current (DC) component has a peak-to-peak relationship represented by a formula below, between a maximum value thereof (referred to as Vpp1) and minimum value thereof (referred to as Vpp2) on a regular toner charge polarity side, $$|Vpp1-Vpp2|\leq 1{,}500\ \text{V}.$$

2. The developing device according to claim 1, wherein in the developing sleeve voltage applying unit, a bias in which an alternating-current (AC) component is superimposed on a direct-current (DC) component has a peak-to-peak relationship represented by a formula below, among a maximum value thereof (referred to as Vpp1) and minimum value thereof (referred to as Vpp2) on a regular toner charge polarity side, and a potential (VL) of an image portion of a latent image over the latent image bearer, $$|Vpp1|>|Vpp2|>|VL|.$$

3. The developing device according to claim 1, wherein in the developing sleeve voltage applying unit, an AC developing bias has a frequency f of 2 (kHz) or lower.

4. The developing device according to claim 1, wherein the carrier comprises a coating layer that comprises the fine particles and a resin, and a content of the fine particles relative to a total amount of the resin and the fine particles in the coating layer is from 10% by mass to 85% by mass.

5. The developing device according to claim 1, wherein the fine particles have a powder resistivity of from −3 (Log Ω·cm) to 3 (Log Ω·cm).

6. The developing device according to claim 1, wherein the fine particles are fine particles that comprise one or more of alumina, silica, titanium, barium, tin, and carbon.

7. The developing device according to claim 1, wherein the carrier comprises a coating layer that comprises the fine particles and a resin, and a dispersed particle diameter of the fine particles in the coating layer is from 50 nm to 600 nm.

8. The developing device according to claim 1, comprising:

a low friction surface layer over the outer circumferential surface of the developing sleeve, wherein a coefficient of friction of the low friction surface layer with respect to the toner is smaller than that of a material of a sleeve element tube forming the cylindrical shape with respect to the toner.

9. The developing device according to claim 8, wherein the material of the sleeve element tube is aluminium.

10. The developing device according to claim 8, wherein the low friction surface layer is made of tetrahedral amorphous carbon.

11. An image forming apparatus, comprising:

a latent image bearer;

a latent image forming unit configured to form a latent image over the latent image bearer;

a developing unit configured to form a toner image by developing the latent image formed over the latent image bearer with a developer;

a transfer unit configured to transfer the toner image formed over the latent image bearer to a recording medium; and a fixing unit configured to fix the toner image transferred to the recording medium thereon, wherein the developing device according to claim 1 is the developing unit.

* * * * *